US010078287B2

(12) United States Patent
Nagahashi

(10) Patent No.: US 10,078,287 B2
(45) Date of Patent: Sep. 18, 2018

(54) IMAGE FORMING APPARATUS WHICH SETS VOLTAGE RANGE FOR CHARGING AN IMAGE BEARING MEMBER

(71) Applicant: CANON FINETECH INC., Misato-shi, Saitama (JP)

(72) Inventor: Yuki Nagahashi, Yokohama (JP)

(73) Assignee: CANON FINETECH NISCA INC., Saitama (JP)

( * ) Notice: Subject to any disclaimer, the term of this patent is extended or adjusted under 35 U.S.C. 154(b) by 0 days.

(21) Appl. No.: 15/109,379

(22) PCT Filed: Dec. 2, 2015

(86) PCT No.: PCT/JP2015/005980
§ 371 (c)(1),
(2) Date: Jun. 30, 2016

(87) PCT Pub. No.: WO2016/088366
PCT Pub. Date: Jun. 9, 2016

(65) Prior Publication Data

US 2016/0349657 A1 Dec. 1, 2016

(30) Foreign Application Priority Data

Dec. 2, 2014 (JP) ..... 2014-243702
Nov. 30, 2015 (JP) ..... 2015-232974

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
(Continued)

(56) References Cited

U.S. PATENT DOCUMENTS 5,144,368 A * 9/1992 Ohzeki ..... G03G 15/0283 399/176
6,532,347 B2 3/2003 Watanabe et al. ..... 399/50
(Continued)

FOREIGN PATENT DOCUMENTS

JP H03-156476 A 7/1991
JP 08022170 A * 1/1996
(Continued)

OTHER PUBLICATIONS

English machine translation of JP 08-022170 A.*
(Continued)

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

Provided is an image forming apparatus capable of appropriately setting a range of a charging voltage for electrically charging an image bearing member. A charging roller (2) and a charging power source (S1) are configured to apply a voltage between the charging roller (2) and a photosensitive drum (1) to electrically charge the photosensitive drum (1). A control circuit (13) is configured to set a voltage for obtaining a predetermined discharge current by the charging roller (2) with the photosensitive drum (1). The control circuit (13) is configured to determine, depending on a state of a resistance acting on an electric current flowing between the charging roller (2) and the photosensitive drum (1), at least one of an upper limit or a lower limit of the voltage set by the control circuit (13).

4 Claims, 15 Drawing Sheets

(58) Field of Classification Search
USPC ..... 399/50
See application file for complete search history.

(56) References Cited

U.S. PATENT DOCUMENTS

| | | | | |
|---|---|---|---|---|
| 2001/0019669 | A1 | 9/2001 | Watanabe et al. | 399/50 |
| 2007/0127939 | A1 | 6/2007 | Kitajima | 399/50 |
| 2010/0111550 | A1 | 5/2010 | Kubo | 399/50 |
| 2010/0239286 | A1 | 9/2010 | Hanashi | 399/50 |
| 2013/0177328 | A1 | 7/2013 | Fukuda et al. | 399/43 |

FOREIGN PATENT DOCUMENTS

| | | |
|---|---|---|
| JP | H08-22170 A | 1/1996 |
| JP | 2001-201921 | 7/2001 |
| JP | 2001-201922 | 7/2001 |
| JP | 2004-021033 | 1/2004 |
| JP | 2008-015268 | 1/2008 |
| JP | 2011-133686 | 7/2011 |

OTHER PUBLICATIONS

International Preliminary Report on Patentability and Written Opinion dated Jun. 15, 2017 in counterpart International Application PCT/JP2015/005980 with English translation.
Notification of Reasons for Refusal dated Sep. 11, 2017 in counterpart Japanese Application No. 2015-232974, with English translation.
Extended European Search Report dated Jun. 20, 2018, in counterpart European Application No. 15866358.3.

* cited by examiner

IMAGE FORMING APPARATUS WHICH SETS VOLTAGE RANGE FOR CHARGING AN IMAGE BEARING MEMBER

TECHNICAL FIELD

The present invention relates to an image forming apparatus, which is configured to electrically charge an image bearing member.

BACKGROUND ART

There is widely used an image forming apparatus, which is configured to apply a charging voltage, which is obtained by superimposing an AC voltage on a DC voltage, to a charging member (for example, charging roller), which is brought into contact with or near a circumferential surface of a rotating image bearing member, to thereby electrically charge the image bearing member. The AC voltage of the charging voltage has a peak-to-peak voltage that is equal to or more than twice an electric discharge start voltage between the image bearing member and the charging member, and electrically charges the circumferential surface of the image bearing member to a potential of the DC voltage of the charging voltage accompanying electric discharge between the image bearing member and the charging member.

When the AC voltage of the charging voltage is too high, overdischarge occurs, with the result that the surface of the image bearing member becomes rough, or a circumferential surface of the charging member is soiled. On the other hand, when the AC voltage of the charging voltage is too low, underdischarge occurs to impair uniformity of a charged state of the surface of the image bearing member, with the result that uneven density and a noise pattern are disadvantageously generated in an output image. Therefore, a setting mode for the AC voltage is executed before starting image formation or at intervals in the image formation to appropriately set the AC voltage of the charging voltage (Patent Literature 1).

In the setting mode described in Patent Literature 1, each of the AC voltage having the peak-to-peak voltage that is equal to or more than twice the electric discharge start voltage between the image bearing member and the charging member, and an AC voltage having a peak-to-peak voltage that is less than twice the electric discharge start voltage is applied to the charging member in a plurality of steps. Then, an AC current flowing through the charging member is measured in a state in which each AC voltage is applied, and a peak-to-peak voltage of an AC voltage of a charging voltage to be used during the image formation is set based on a measurement result of the AC current.

CITATION LIST

Patent Literature

PTL 1: Japanese Patent Application Laid-Open No. 2001-201921

SUMMARY OF INVENTION

Technical Problem

In a setting mode for an AC voltage, an inappropriate peak-to-peak voltage of the AC voltage may be disadvantageously set in some cases due to accidents such as overlapping of some parameters and a large error in measuring the AC current. At such time, when the peak-to-peak voltage of the AC voltage is too high or too low, there is a fear that image defects such as image deletion and a sand pattern may appear. Therefore, it has been proposed to set an upper limit and a lower limit to the peak-to-peak voltage of the AC voltage, which is set in the setting mode for the AC voltage, to thereby set the peak-to-peak voltage of the AC voltage in a range between the upper and lower limits. In this manner, the peak-to-peak voltage is replaced by the upper limit when the peak-to-peak voltage is calculated to exceed the upper limit in the setting mode for the AC voltage, and the peak-to-peak voltage is replaced by the lower limit when the peak-to-peak voltage is calculated to fall below the lower limit, to thereby address the above-mentioned problem.

However, when a width between the upper limit and the lower limit is small, the peak-to-peak voltage at the upper limit or the lower limit, which is a fixed value, is set in many cases, and there is no significance in performing a measurement mode for the AC voltage. On the other hand, when the width between the upper limit and the lower limit is large, the peak-to-peak voltage is not replaced, and the inappropriate peak-to-peak voltage of the AC voltage is more likely to be set.

It is an object of the present invention to provide an image forming apparatus, which is capable of setting an appropriate range of a charging voltage for electrically charging an image bearing member.

Solution to Problem

According to one embodiment of the present invention, there is provided an image forming apparatus, comprising: an image bearing member; a charging unit configured to charge the image bearing member by applying a voltage between the charging unit and the image bearing member; a setting unit configured to set a voltage for obtaining a predetermined discharge current between the charging unit and the image bearing member by the charging unit; and a determination unit configured to determine, in accordance with a state of a resistance acting on an electric current flowing between the charging unit and the image bearing member, at least one of an upper limit and a lower limit of the voltage set by the setting unit.

Advantageous Effects of Invention

According to the image forming apparatus of the present invention, the appropriate range of the charging voltage for electrically charging the image bearing member can be set.

DESCRIPTION OF EMBODIMENTS

Now, embodiments of the present invention will be described in detail with reference to the drawings.

First Embodiment (Image Forming Apparatus)

Figure 1:
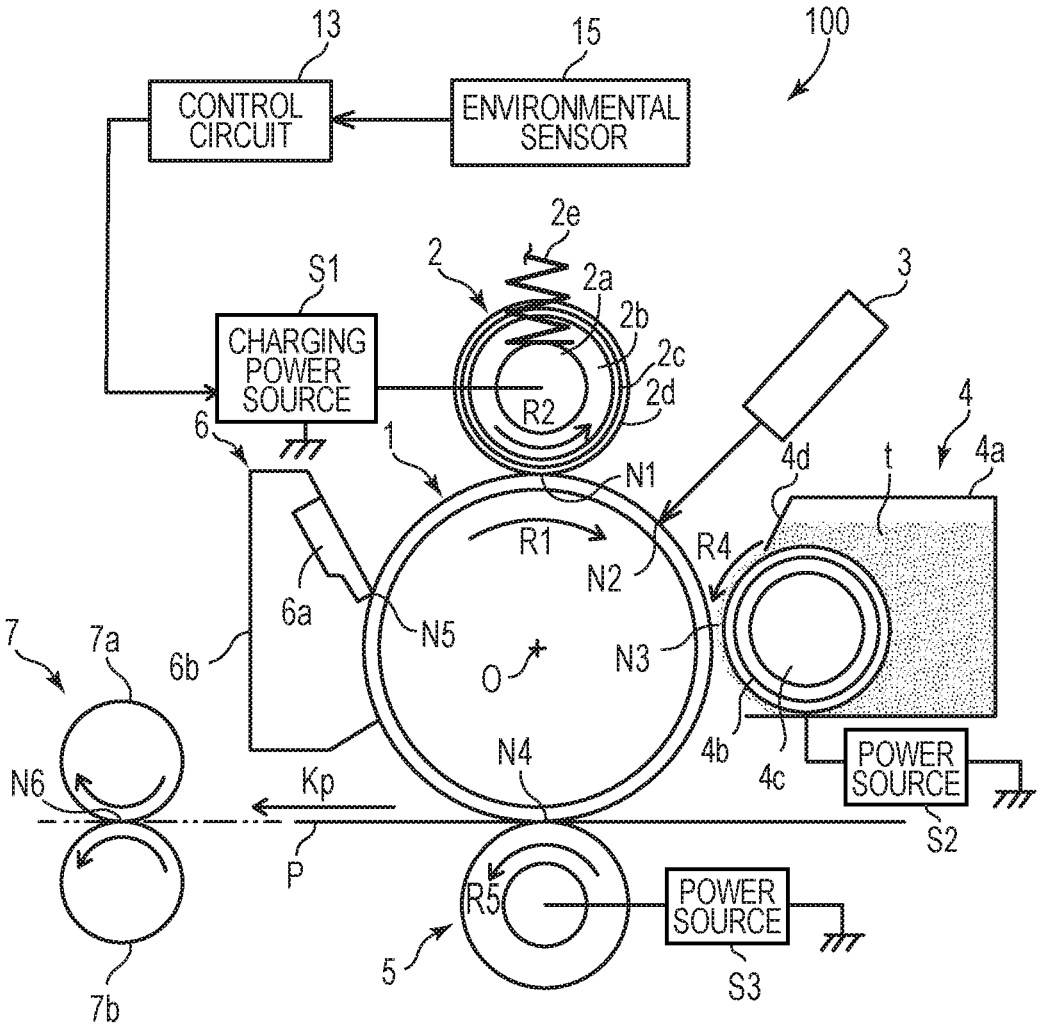
FIG. 1 is an explanatory diagram for illustrating the structure of an image forming apparatus.
Figure 2:
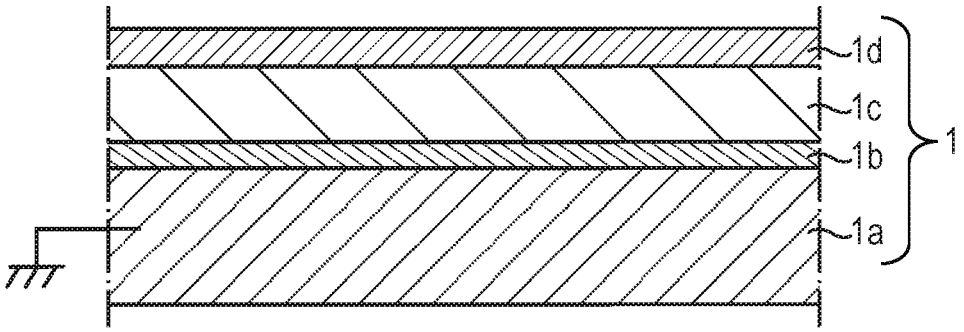
FIG. 2 is an explanatory view of the layer structure at a surface of a photosensitive drum.

FIG. 1 is an explanatory diagram of the structure of an image forming apparatus. FIG. 2 is an explanatory view of the layer structure at a surface of a photosensitive drum. FIG. 1 is a radial cross-sectional view when the image forming apparatus is viewed from a front side, that is, a side on which a user or a serviceman is located during operation. The maximum recording material on which the image forming apparatus can form an image is A3 size.

As illustrated in FIG. 1, an image forming apparatus 100 is a laser beam printer of a contact charging type, a reverse development type, and an electrophotographic type. In the image forming apparatus 100, a charging roller 2, an exposure device 3, a developing device 4, a transfer roller 5, and a drum cleaning device 6 are arranged around a photosensitive drum 1.

The photosensitive drum 1 is an electrophotographic photosensitive member of a rotating drum type having a circumferential surface on which a negatively chargeable organic photoconductor (OPC) is formed by application. The photosensitive drum 1 is configured to have an outer diameter of 30 mm, and to be rotationally driven at a process speed (circumferential speed) of 230 mm/sec about a center axis O in an arrow R1 direction by a drive unit (not shown).

As illustrated in FIG. 2, the photosensitive drum 1 has the structure in which three layers of photosensitive member are applied in order on top of one another on a surface of a conductive base 1*a* of an aluminum cylinder. An undercoat layer 1*b* is configured to suppress interference with light, and to improve an adhesive property with an upper layer. A photo-charge generating layer 1*c* is configured to generate electric charges corresponding to incident light. A charge transporting layer 1*d* is configured to convey electric charges in a photosensitive layer. The conductive base 1*a* is connected to a ground potential.

The charging roller 2 is configured to subject the circumferential surface of the photosensitive drum 1 to processing of charging the circumferential surface to a uniformly negative dark section potential VD. The exposure device 3 is configured to use a laser beam scanner, which uses a semiconductor laser, to form an electrostatic image on the circumferential surface of the photosensitive drum 1. The exposure device 3 is configured to output laser light modulated to correspond to image information, which is transmitted from a host device, such as an image reading device (not shown), and to subject the circumferential surface of the photosensitive drum 1, which is configured to rotate in a sub-scanning direction, to scanning exposure in a main scanning direction. The image on the circumferential surface of the photosensitive drum 1, which has been subjected to the charging processing, is subjected to the scanning exposure to the laser light in an exposure portion N2, with the result that the electric charges in the exposure portion are removed, to thereby form an electrostatic image corresponding to image information in which the dark section potential VD is lowered to a light section potential VL.

The developing device 4 is configured to develop the electrostatic image formed on the photosensitive drum 1 with toner. The developing device 4 includes a developing container 4*a*, a non-magnetic developing sleeve 4*b*, a magnet roller 4*c*, and a regulating blade 4*d*. The developing container 4*a* contains a single component magnetic toner (hereinafter simply referred to as "toner" as appropriate) "t" having a negatively chargeable characteristic as a developer. At an opening of the developing container 4*a*, which is opposed to the photosensitive drum 1, the developing sleeve 4*b* is arranged to be rotatable in an arrow R4 direction. The magnet roller 4*c* is fixedly arranged inside the developing sleeve 4*b*. The toner "t" in the developing container 4*a* is carried on a surface of the developing sleeve 4*b* with magnetism of the magnet roller 4*c*, and is conveyed to a developing portion (developing position) N3 after being regulated for layer thickness by the regulating blade 4*d* with the rotation of the developing sleeve 4*b* in the arrow R4 direction.

To the developing sleeve 4*b*, a developing voltage is applied by a power source S2. When the developing voltage is applied by the power source S2, the toner "t" on the developing sleeve 4*b* is selectively deposited on the electrostatic image on the surface of the photosensitive drum 1 to develop a toner image. Here, reverse development in which the toner "t" is deposited on the exposure portion on the photosensitive drum 1 is executed. Toner "t" not used for the development is passed through the developing portion N3 and is returned to the inside of the developing container 4*a*.

The transfer roller 5 is brought into press contact with the surface of the photosensitive drum 1 from below to form a transfer portion N4 with the photosensitive drum 1. The transfer roller 5 is configured to be rotated in an arrow R5 direction by rotation of the photosensitive drum 1 in the arrow R1 direction. To the transfer roller 5, a transfer voltage, which is a DC voltage having a positive polarity, is applied from a power source S3.

A recording material P is taken out one by one from a stocker (not shown) to be supplied to the transfer portion N4 by a conveyance roller (not shown), and passes through the transfer portion N4 while being sandwiched and fed in an arrow Kp direction. When the recording material P passes through the transfer portion N4, the transfer voltage is applied to the transfer roller 5, with the result that the toner image on the photosensitive drum 1 is electrostatically transferred onto the recording material P.

The drum cleaning device 6 is configured to bring a cleaning blade 6*a* into contact with the surface of the photosensitive drum 1 to form a cleaning portion N5. Transfer residual toner, which has passed through the transfer portion N4 without being transferred onto the recording material P and remains on the surface of the photosensitive drum 1, is scraped off by the cleaning blade 6*a* to be collected into a cleaning container 6*b*.

A fixing device 7 is configured to bring a pressure roller 7*b* into press contact with a fixing roller 7*a*, which has a built-in heater (not shown), from below to form a fixing portion N6. When passing through the fixing portion N6, the recording material P having the surface on which the toner image has been transferred is heated and pressed so that the image is fixed on the surface of the recording material P.

The image forming apparatus 100 is configured to, with the rotation of the photosensitive drum 1, successively execute the above-mentioned processes of the charging, the exposure, the development, the transfer, the cleaning, and the fixing to form an image on a surface of one recording material P.

(Operation Sequence of Image Forming Apparatus)

Figure 3:
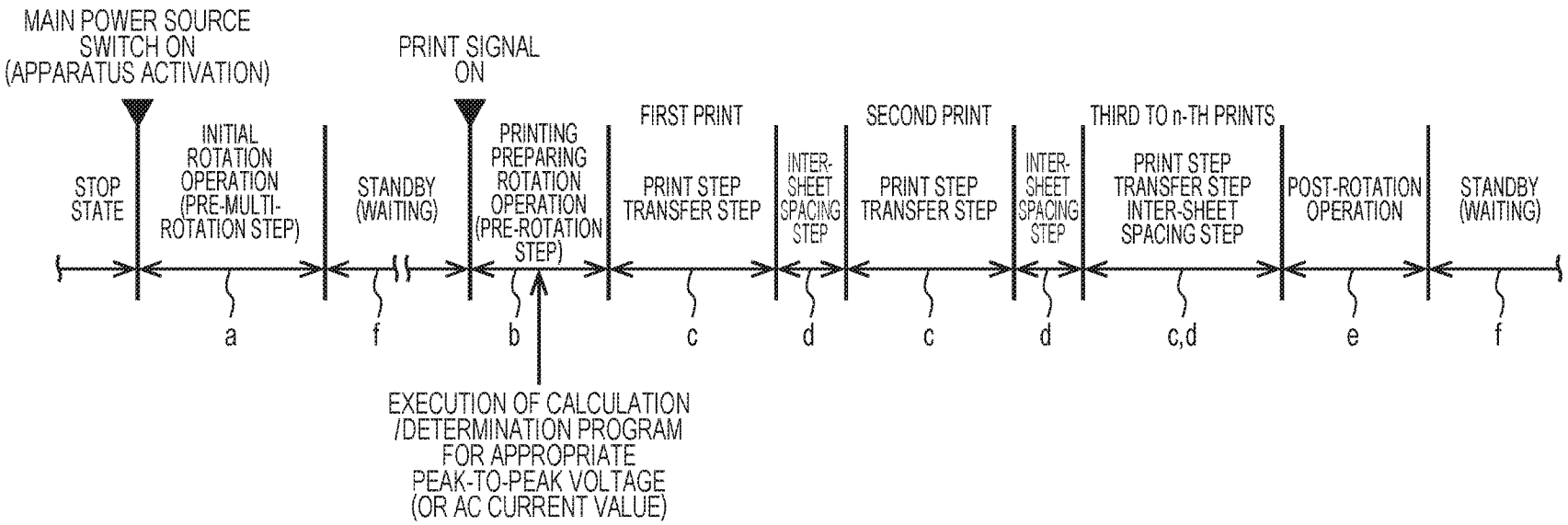
FIG. 3 is a time chart of an operation sequence of the image forming apparatus.

FIG. 3 is a time chart of an operation sequence of the image forming apparatus. As illustrated in FIG. 3 with reference to FIG. 1, when a main power source of the image forming apparatus 100 in a stop state is switched on, an initial rotation operation a is started. In FIG. 3, a print step c corresponds to a time when an image is formed, and the initial rotation operation a, a printing preparing rotation operation b, an inter-sheet spacing step d, and a post-rotation operation e correspond to times when no image is formed.

a. Initial Rotation Operation (Pre-Multi-Rotation Step)

The initial rotation operation is a starting operation period (activation operation period or warming period) during activation of the image forming apparatus 100. The main power source is switched on to start rotationally driving the photosensitive drum 1, raise the fixing device 7 to a predetermined temperature, and execute preparing operations of the other process devices.

b. Printing Preparing Rotation Operation (Pre-Rotation Step)

The printing preparing rotation operation is a preparing rotation operation period from when a print signal becomes on to when operations in an image forming (printing) step are actually performed before the image formation. When the print signal is input during the initial rotation operation, the printing preparing rotation operation is executed subsequently. When there is no input of the print signal by the end of the initial rotation operation, the drive of a main motor is stopped to stop the rotational drive of the photosensitive drum 1, and the image forming apparatus 100 shifts to a standby waiting state.

c. Print Step, Transfer Step

After the end of the printing preparing rotation operation, an imaging process (image forming step, imaging step) on the rotating photosensitive drum 1 is subsequently executed. In the imaging process, as described above, the toner image is formed on the surface of the photosensitive drum 1, and the toner image is transferred onto the recording material P. Then, the recording material P on which the toner image has been transferred is fixed by the fixing device 7, and the recording material on which the image is fixed is printed out. In a case of continuous image formation, the imaging process is repetitively executed for a predetermined set number n.

d. Inter-Sheet Spacing Step

In the continuous image formation, the inter-sheet spacing step is a period from when a trailing end of a preceding recording material P has passed through the transfer portion N4 to when a leading end of a subsequent recording material P reaches the transfer portion N4, during which a recording material P is not nipped at the transfer portion N4.

e. Post-Rotation Operation

The post-rotation operation is a period in which, after a print step for the last recording material P is ended, the drive of the main motor is continued for some time to rotationally drive the photosensitive drum 1, to thereby execute a predetermined post-rotation operation.

f. Standby

When the post-rotation operation is ended, the drive of the main motor is stopped to stop the rotational drive of the photosensitive drum 1, and the image forming apparatus 100 is maintained in a standby (waiting) state until the next print signal is input. In the standby state, when the print signal is input, the image forming apparatus 100 shifts to a pre-rotation step. In a case of printing and outputting only one sheet, after the printing and outputting is ended, the image forming apparatus 100 shifts to the post-rotation operation and then to the standby state.

(Contact Charging Type)

The image forming apparatus of the contact charging type is configured to apply a voltage to a charging member, which is brought into contact with or near an image bearing member, to electrically charge the surface of the image bearing member. Examples of the charging member are a roller-shaped charging roller and a blade-shaped charging blade. The charging roller, which does not involve rubbing, may electrically charge the image bearing member in a stable manner for a longer period of time than the charging blade.

A case where an oscillating voltage, which is obtained by superimposing an AC voltage Vac on a DC voltage Vdc, is applied to the charging member so that electric discharge is repeated alternately between the charging member and the image bearing member provides the effect of uniforming a surface potential, and hence is preferred because the surface of the image bearing member may be electrically charged in an uniform manner. It is preferred that, the AC voltage Vac having a peak-to-peak voltage that is equal to or more than twice an electric discharge start voltage Vth of the image bearing member when the DC voltage Vdc is applied be used as the oscillating voltage. In the case where the oscillating voltage, which is obtained by the superimposition of the DC voltage Vdc and the AC voltage Vac, is applied, in addition to a DC current Idc caused by the DC voltage Vdc, an AC current Iac caused by the AC voltage Vac is generated between the charging member and the image bearing member.

A waveform of the AC voltage Vac is not limited to a sine wave, and may be a rectangular wave, a triangular wave, or a pulse wave. Moreover, examples of the oscillating voltage include a voltage of a rectangular wave, which is formed by periodically turning the DC voltage OFF/ON, and a voltage formed by periodically changing a value of the DC voltage to obtain the same output as the voltage obtained by the superimposition of the AC voltage and the DC voltage.

In a case where the AC voltage Vac is used, the charging member does not necessarily need to be in contact with the surface of the image bearing member. As long as a dischargeable region, which is determined by a gap voltage and the modified Paschen's curve, is reliably secured between the charging member and a contact member, the charging member may be arranged in proximity in a non-contact manner with a gap of about 10 μm. Therefore, the term "contact charging" as used herein also includes the case of proximity charging.

(Control of Discharge Current Amount)

In image forming apparatus, a contact charging type in which the oscillating voltage is applied to the charging member to electrically charge the image bearing member is referred to as an "AC charging type", and a contact charging type in which only the DC voltage is applied to electrically charge the image bearing member is referred to as a "DC charging type". The AC charging type is increased in amount of electric discharge to the image bearing member as compared to the DC charging type, and hence degradation of the image bearing member, such as a scratch on the image bearing member, is more likely to be facilitated. Further, an abnormal image such as image deletion in a high-temperature, high-humidity (H/H) environment due to an electric discharge product is more likely to be generated. Therefore, it is effective to apply the AC voltage Vac of a minimum required peak-to-peak voltage value Vpp to minimize an amount of discharge current, which is generated alternately between the charging member and the image bearing member.

However, in reality, a relationship between the applied peak-to-peak voltage value Vpp and the discharge current amount is not always constant, but is changed with film thicknesses of a photosensitive member layer and a dielectric layer of the image bearing member, environmental variations of the charging member and air, and other such factors. For example, in a low-temperature, low-humidity environment with a temperature of 15° C. and a humidity of 10%, resistance values of the image bearing member and the charging roller are increased, and the electric discharge becomes harder to occur, with the result that a fairly high peak-to-peak voltage value Vpp is required to obtain a required amount of discharge current.

However, when the peak-to-peak voltage value Vpp for obtaining a minimum required amount of discharge current in the low-temperature, low-humidity environment is used in the same image forming apparatus and in a high-temperature, high-humidity environment with a temperature of 30° C. and a humidity of 80%, more than required amount of discharge current is disadvantageously allowed to flow. When the discharge current amount is increased, there arise problems of the image deletion, generation of blur, generation of toner fusion bonding, degradation of the surface of the image bearing member, and a scratch and shortened life of the image bearing member.

Therefore, as described later, in a first embodiment of the present invention, an output range of the peak-to-peak voltage value Vpp is determined to avoid a situation in which more than required amount of discharge current is disadvantageously allowed to flow.

(Charging Roller)

Figure 4:
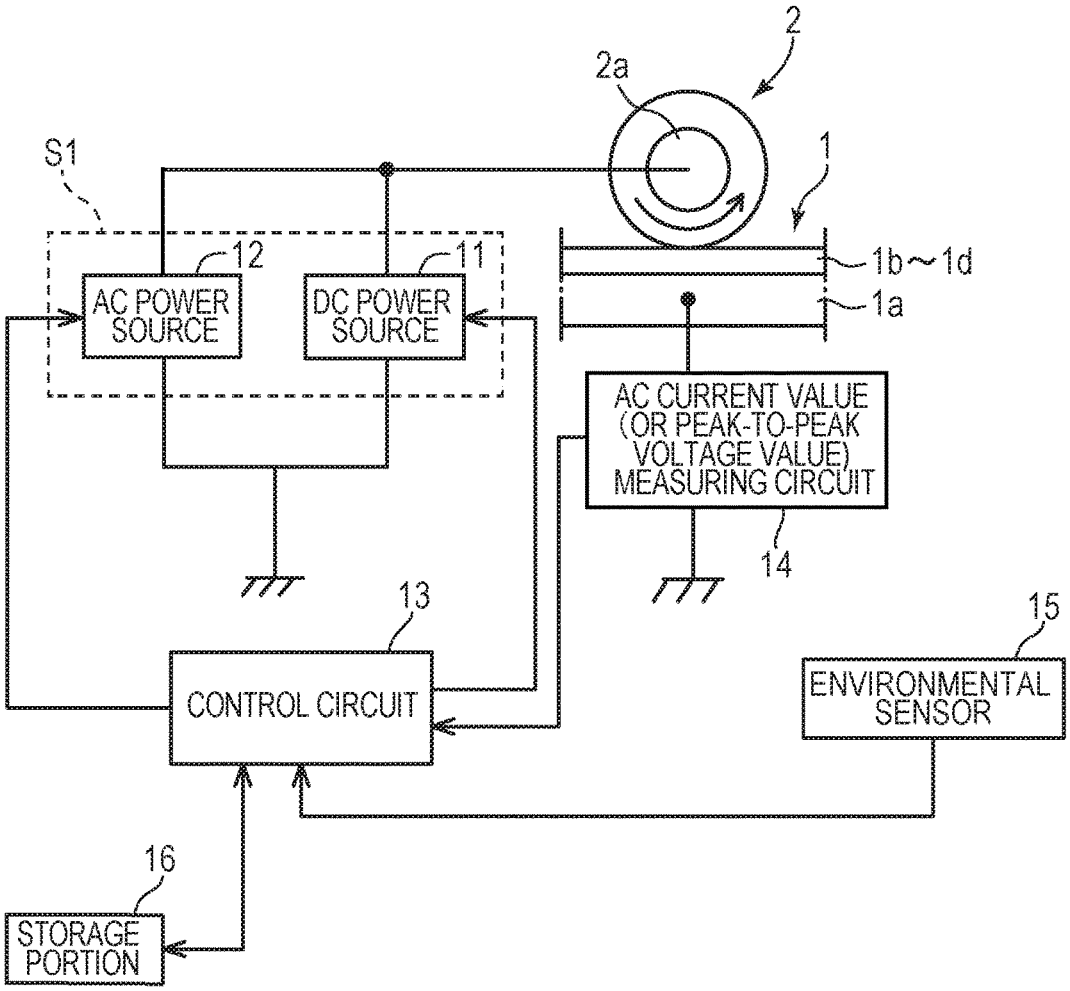
FIG. 4 is a block circuit diagram of a control system for a charging voltage to be applied to a charging roller.

FIG. 4 is a block circuit diagram of a control system for a charging voltage to be applied to the charging roller. As illustrated in FIG. 1, the charging roller 2 is rotatably held by bearing members (not shown) at both end portions of a core metal 2*a* thereof in a longitudinal direction, and is urged toward the photosensitive drum 1 by a pressing spring 2*e*. The charging roller 2 is brought into contact with the surface of the photosensitive drum 1 with a predetermined pressing force to rotate in an arrow R2 direction with the rotation of the photosensitive drum 1 in the arrow R1 direction. A region before and after, and including a press contact portion, at which the photosensitive drum 1 and the charging roller 2 are brought into contact with each other, forms a charging portion N1. A charging power source S1 is configured to apply the charging voltage to the core metal 2*a* of the charging roller 2 under a predetermined condition. As a result, an outer circumferential surface (surface) of the rotating photosensitive drum 1 is electrically charged to a predetermined polarity and potential. The surface of the photosensitive drum 1 is electrically charged to the dark section potential VD having a negative polarity in a uniform manner.

As illustrated in FIG. 4, the charging roller 2 and the charging power source S1, which are an example of a charging unit, are configured to apply a voltage between the photosensitive drum 1, which is an example of the image bearing member, and the charging roller 2 to electrically charge the photosensitive drum 1. The charging power source S1 is configured to apply a charging voltage (Vdc+Vac), which is the oscillating voltage obtained by the superimposition between the DC voltage Vdc and the AC voltage Vac having a frequency f, to the core metal 2*a* of the charging roller 2. The charging power source S1 includes a direct current power source (DC power source) 11 and an alternating current power source (AC power source) 12. The DC power source 11 and the AC power source 12 are controlled by a control circuit 13.

The control circuit 13 is capable of controlling the DC power source 11 and the AC power source 12 to be on/off to apply one or a superimposed voltage of both of a DC voltage and an AC voltage to the charging roller 2. The control circuit 13 has a function of controlling a value of the DC voltage to be applied from the DC power source 11 to the charging roller 2, and the peak-to-peak voltage value of the AC voltage to be applied from the AC power source 12 to the charging roller 2.

The control circuit 13 has a function of calculating an appropriate peak-to-peak voltage value of the applied AC voltage based on AC current value information, which is input from an AC current value measuring circuit 14, and environmental information, which is input from an environmental sensor 15.

The AC current value measuring circuit 14, which is an example of a current detection unit, is configured to detect an electric current flowing between the photosensitive drum 1 and the charging roller 2. The AC current value measuring circuit 14 is configured to measure an AC current value of the applied AC voltage, and to input the measured AC current value to the control circuit 13. The control circuit 13 is configured to determine at least one of an upper limit or a lower limit of a voltage set by the control circuit 13 depending on a state of resistance acting on the electric current flowing between the charging roller 2 and the photosensitive drum 1. The control circuit 13 is configured to determine the appropriate peak-to-peak voltage value (or AC current value) of the applied AC voltage based on the AC current value measured by the AC current value measuring circuit 14.

The environmental sensor 15, which is an example of a temperature detection unit, is configured to detect temperature around the charging roller 2. The control circuit 13 is configured to determine the upper limit of the voltage, which is set by the control circuit 13, to be lower as the temperature around the charging roller 2 becomes higher, based on a detection result of the environmental sensor 15. The environmental sensor 15, which is an example of a humidity detection unit, is configured to detect humidity around the charging roller 2. The control circuit 13 is configured to determine the upper limit of the voltage, which is set by the control circuit 13, to be lower as an amount of water in air around the charging roller 2 becomes larger, based on a detection result of the environmental sensor 15. The control circuit 13 is configured to adjust the peak-to-peak voltage value (or AC current value) of the applied AC voltage depending on the amount of water in the air based on the temperature and the humidity, which are measured by the environmental sensor 15.

A storage portion 16 is configured to store the AC current value or the peak-to-peak voltage value, which is measured by the AC current value measuring circuit 14.

The DC power source 11 and the AC power source 12 in FIG. 4 are used to apply the DC voltage Vdc and the AC voltage Vac having the peak-to-peak voltage value Vpp that is equal to or more than twice the electric discharge start voltage Vth to the charging roller 2. As a result, electric discharge is generated between the photosensitive drum 1 and the charging roller 2 to electrically charge the circumferential surface of the photosensitive drum 1 to the uniform potential (Vdc). The amount of discharge current generated between the photosensitive drum 1 and the charging roller 2 by the application of the AC voltage Vac has a strong correlation with a scratch on the photosensitive drum 1, the image deletion, and charging uniformity.

(Discharge Current Amount)

Figure 5:
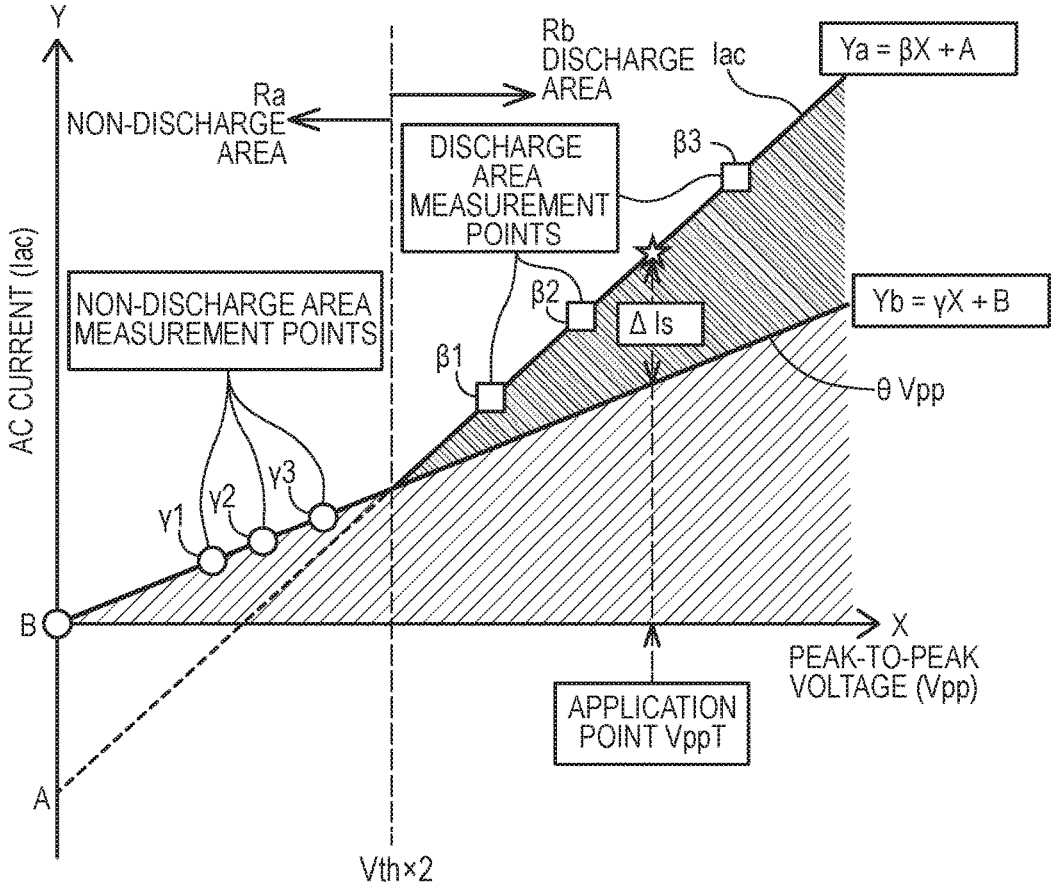
FIG. 5 is an explanatory graph of a relationship between a peak-to-peak voltage of an AC voltage and a discharge current amount.
Figure 6:
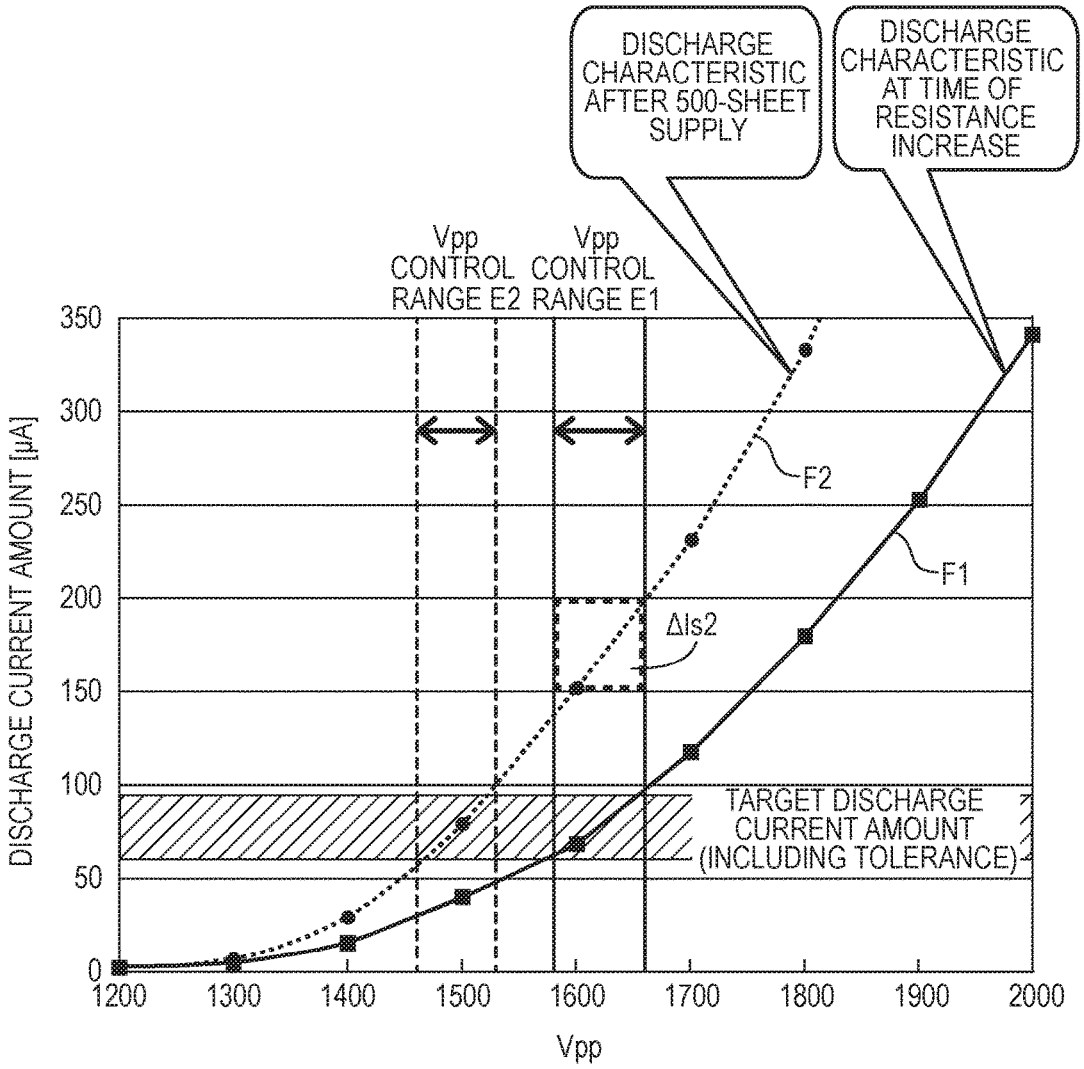
FIG. 6 is an explanatory graph of a range of a peak-to-peak voltage of an AC voltage in which an appropriate amount of discharge current is obtained.

FIG. 5 is an explanatory graph of a relationship between the peak-to-peak voltage of the AC voltage and the discharge current amount. FIG. 6 is an explanatory graph of a range of the peak-to-peak voltage of the AC voltage in which an appropriate amount of discharge current is obtained. As shown in FIG. 5, the AC current Iac shown on the Y axis (vertical axis) is changed depending on the peak-to-peak voltage value Vpp shown on the X axis (horizontal axis) as follows.

In a non-discharge area Ra in which the peak-to-peak voltage value Vpp is less than the electric discharge start voltage Vth×2 (V), the AC current Iac has a linear relationship passing through the origin with respect to the peak-to-peak voltage value Vpp. In contrast, in a discharge area Rb in which the peak-to-peak voltage value Vpp exceeds the electric discharge start voltage Vth×2, the AC current Iac has a linear relationship that deviates, from the above-mentioned linear relationship passing through the origin, in a direction of increasing current as the peak-to-peak voltage value Vpp becomes higher.

Note that, in a similar experiment conducted in vacuum, in which the electric discharge does not occur, the linearity passing through the origin was maintained also in the discharge area Rb. Therefore, the deviation portion is conceived to be an increment ΔIs in current involved in the electric discharge.

A ratio (Iac/Vpp) of an electric current Iac with respect to the peak-to-peak voltage value Vpp that is less than the electric discharge start voltage Vth×2 (V) is represented by θ. At this time, an AC current, such as an electric current (hereinafter referred to as "nip current") flowing to a contact portion (contact portion between the photosensitive drum 1 and the charging roller 2), other than the electric current generated by the electric discharge, becomes θVpp. A difference ΔIs between Iac, which is measured at the time of application of the voltage that is equal to or more than the electric discharge start voltage Vth×2 (V), and θVpp is defined as a discharge current amount ΔIs, which substitutionally represents an amount of discharge.

$$\Delta Is = Iac - \theta Vpp \quad (1)$$

When the electric charging is performed under control with a constant voltage or a constant current, the discharge current amount ΔIs changes with a change in environment or a progress of durability. This is because the relationship between the peak-to-peak voltage value Vpp and the discharge current amount ΔIs, and the relationship between the AC current value (electric current Iac) and the discharge current amount ΔIs vary with the change in environment and the progress of durability.

As shown in FIG. 6, in the first embodiment, to the peak-to-peak voltage value Vpp to be applied depending on a control result obtained when discharge current control is performed, a range of an outputtable voltage value is set in advance based on a result of an experiment so that the discharge current amount falls within an appropriate range in a state in which a resistance value of the charging roller 2 is increased, such as after the power is turned on or after resuming from sleep.

The reason why the range of the outputtable voltage value is set is that various problems occur when the peak-to-peak voltage value Vpp is too high or too low. Therefore, the lower limit is set as a range in which image defects due to a charge defect, such as a sand pattern and fogging, may be suppressed, and the upper limit is set as a range in which the image deletion due to generation of ozone and shortened life due to the scratch on the drum may be suppressed.

However, it is assumed that, in order to avoid the image defects, such as the sand pattern in which white spots appear on a black background, a control range E1 of the peak-to-peak voltage value Vpp is set based on a discharge characteristic F1 in the state in which the resistance value of the charging roller 2 is increased and including a tolerance as shown in FIG. 6. At this time, it is assumed that the discharge characteristic F1 is changed to a discharge characteristic F2 after image formation on about 500 sheets. At this time, a control range E2 of the peak-to-peak voltage value Vpp needs to be set for the discharge characteristic F2, and an excessive amount ΔIs2 of discharge current is disadvantageously allowed to flow when the control range E1 is set continuously. As a result, more than required electric discharge is generated, with the result that the surface of the photosensitive drum 1 becomes rough or soiling of the charging roller 2 is facilitated, and that service lives of the photosensitive drum 1 and the charging roller 2 are disadvantageously shortened.

Therefore, in the first embodiment, the control range of the peak-to-peak voltage value Vpp is determined based on the discharge characteristic to obtain an appropriate control range of the peak-to-peak voltage value Vpp.

(Control in First Embodiment)

Figure 7A:
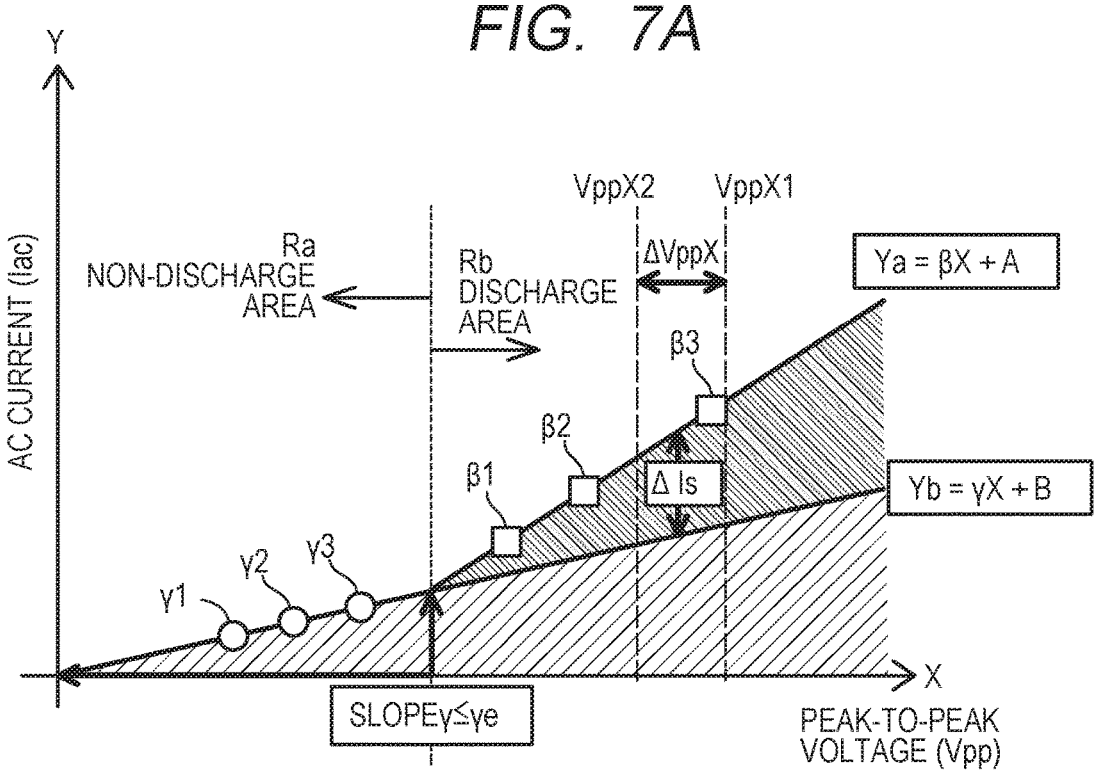
FIG. 7A is an explanatory graph of a concept of discharge current control in a first embodiment of the present invention.
Figure 7B:
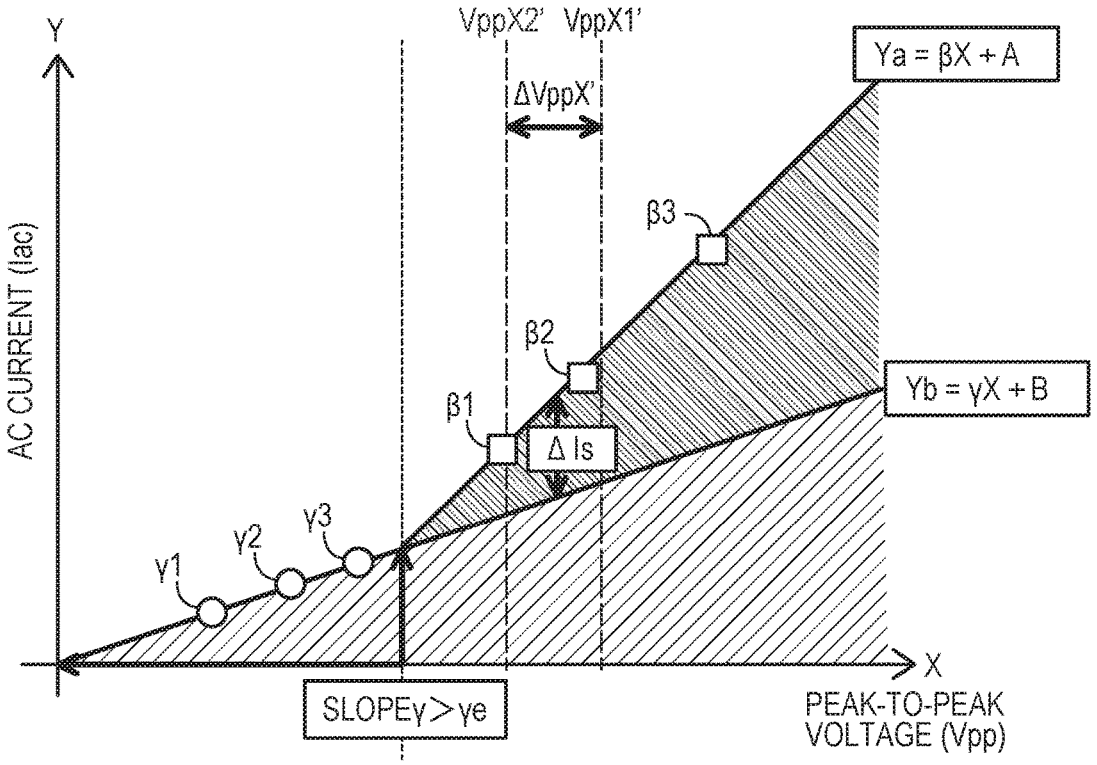
FIG. 7B is an explanatory graph of the concept of the discharge current control in the first embodiment.
Figure 8:
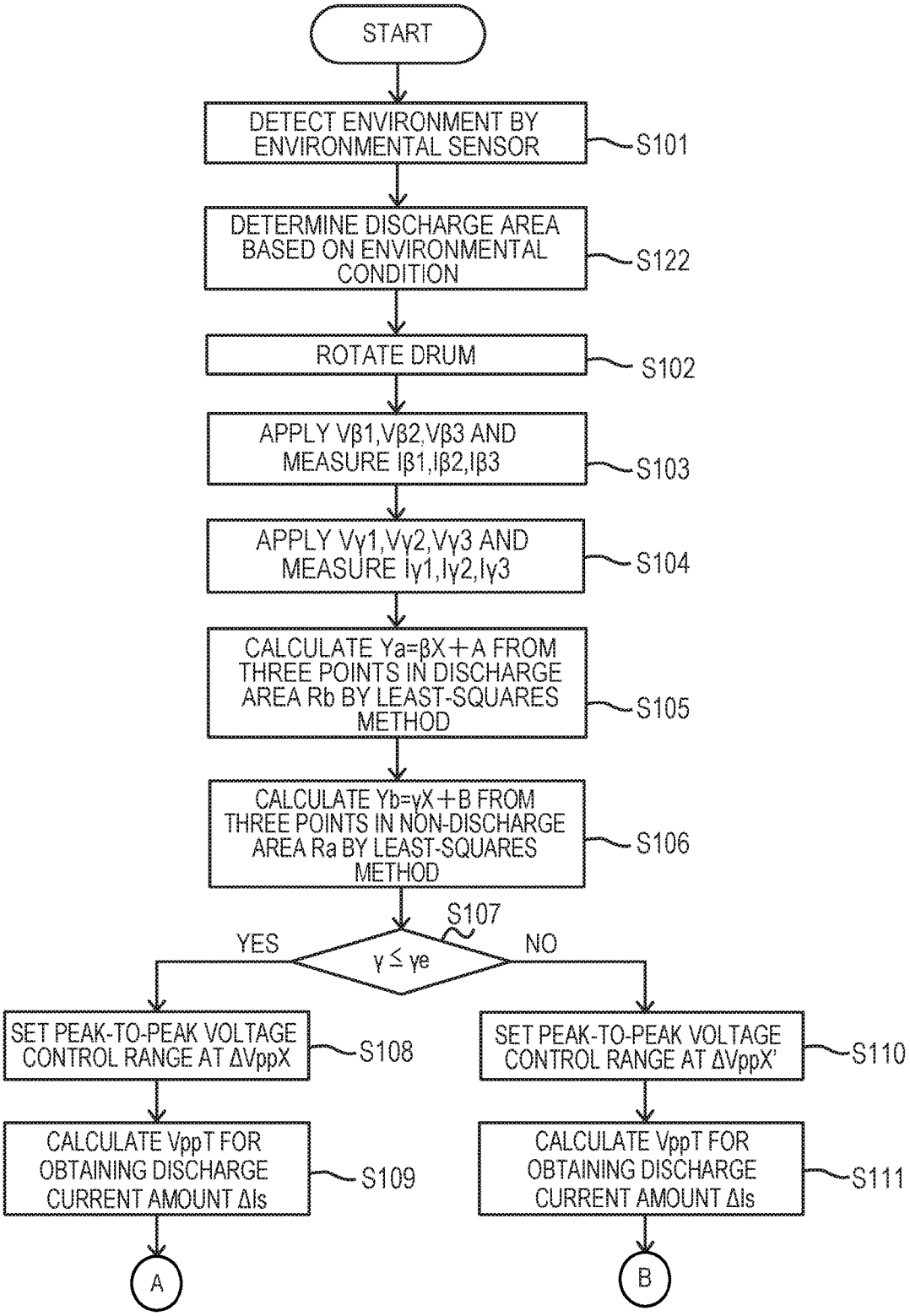
FIG. 8 is a first half portion of a flow chart of control in the first embodiment.
Figure 9A:
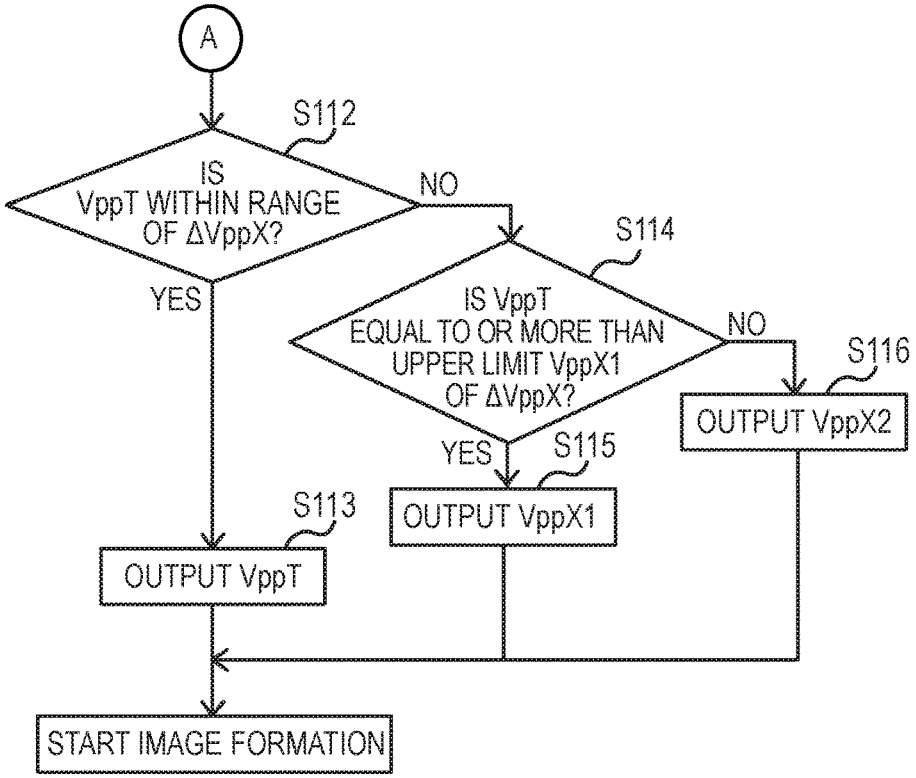
FIG. 9A is a second half of the flow chart of the control in the first embodiment.
Figure 9B:
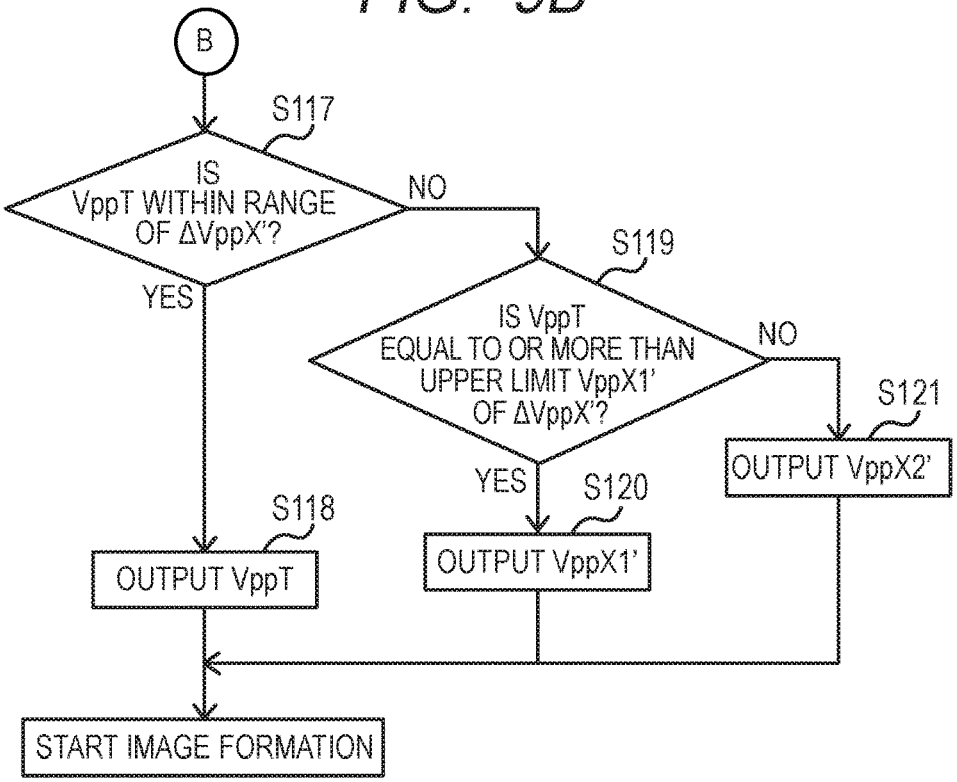
FIG. 9B is a second half of the flow chart of the control in the first embodiment.

FIG. 7A and FIG. 7B are explanatory graphs of a concept of the discharge current control in the first embodiment. FIG. 8 is a first half portion of a flow chart of control in the first embodiment. Each of FIG. 9A and FIG. 9B is a second half of the flow chart of the control in the first embodiment. FIG. 7A corresponds to a state in which a resistance of the charging roller is high, and FIG. 7B corresponds to the state in which the resistance of the charging roller is lowered after the image formation on about 500 sheets.

As illustrated in FIG. 3, in an initial rotation operation period and at periodic timings in a printing preparing rotation operation period, the control circuit 13 (FIG. 4) executes a calculation/determination program for the appropriate peak-to-peak voltage value (or AC current value) of the applied AC voltage in a charging step of the print step.

As shown in FIG. 7A, it is assumed that, after being left to stand for a long period of time in the low-temperature, low humidity environment, the image forming apparatus 100 is activated, and that the first setting of the peak-to-peak voltage value is executed. Then, it is assumed that the image formation on 500 sheets is executed, and that, as shown in FIG. 7B, the second setting of the peak-to-peak voltage value is executed. During that time, the charging roller 2 is reduced in resistance value with the increase in temperature, and hence the AC current Iac is increased. The discharge current amount ΔIs is increased to an unnecessary level to give room to reduce the peak-to-peak voltage value Vpp of the AC voltage Vac.

As illustrated in FIG. 8 with reference to FIG. 4, the control circuit 13 performs detection of temperature and humidity by the environmental sensor 15 (S101). Then, the control circuit 13 determines the peak-to-peak voltage value at which the electric discharge is generated between the charging roller 2 and the photosensitive drum 1 based on detection results of the environmental sensor 15 (S122), and starts the rotation of the photosensitive drum 1 (S102).

The control circuit 13 controls the AC power source 12 to apply only the AC voltage Vac in the discharge area Rb to the charging roller 2, and as shown in FIG. 7A, switches the peak-to-peak voltage value Vpp in three steps: Vβ1, Vβ2, and Vβ3. In synchronization with the switching of the peak-to-peak voltage value Vpp in the three steps, the control circuit 13 uses the AC current value measuring circuit 14 to measure Iβ1, Iβ2, and β3 as AC currents Iac in the discharge area Rb, which flow to the charging roller 2 through the photosensitive drum 1 (S103).

Similarly, the control circuit 13 controls the AC power source 12 to apply only the AC voltage Vac in the non-discharge area Ra to the charging roller 2, and as shown in FIG. 7A, switches the peak-to-peak voltage value Vpp in three steps: Vγ1, Vγ2, and Vγ3. In synchronization with the switching of the peak-to-peak voltage value Vpp in the three steps, the control circuit 13 uses the AC current value measuring circuit 14 to measure Iγ1, Iγ2, and Iγ3 as AC currents Iac in the non-discharge area Ra, which flow to the charging roller 2 through the photosensitive drum 1 (S104).

The control circuit 13 linearly approximates relationships between the peak-to-peak voltage value Vpp and the AC current Iac in the discharge area Rb and the non-discharge area Ra from AC current values at six points, which are measured when the discharge current control is performed, to calculate the expression (2) and expression (3) provided below (S105, S106). As shown in FIG. 7A, those approximate straight lines are: a straight line connecting the origin, a point γ1, a point γ2, and a point γ3 in the non-discharge area Ra (S106), and a straight line passing through a point β1, a point β2, and a point β3 in the discharge area Rb (S105).

As shown in FIG. 5, when the approximate straight line in the discharge area Rb and the approximate straight line in the non-discharge area Ra, which are obtained as described above, are represented by Ya having a slope β and Yb having a slope γ, respectively, the following relationships are established.

$$Ya=\beta X+A \tag{2}$$

$$Yb=\gamma X+B \tag{3}$$

As shown in FIG. 7A, the slope γ of the approximate straight line in the non-discharge area Ra, which is expressed by the above-mentioned expression (3), is changed depending on a conducting state between the charging roller 2 and the photosensitive drum 1, that is, a resistance value between the charging roller 2 and the photosensitive drum 1.

The control circuit 13, which is an example of a control unit, sets at least one of the upper limit or the lower limit of the voltage set by the control circuit 13, based on a detection result of the AC current value measuring circuit 14 obtained when a predetermined voltage is applied between the photosensitive drum 1 and the charging roller 2. In other words, the control circuit 13, which is an example of a determination unit, determines the at least one of the upper limit or the lower limit of the voltage set by the control circuit 13 depending on the state of the resistance acting on the electric current flowing between the charging roller 2 and the photosensitive drum 1. The control circuit 13 determines whether γ has exceeded a predetermined value γe (S107), and when γ is equal to or less than the predetermined value γe (Yes in S107), sets the control range of the peak-to-peak voltage value Vpp at a range ΔVppX, which is shown in FIG. 7A (S108). On the other hand, when γ has exceeded the predetermined value γe (No in S107), the control circuit 13 sets the control range of the peak-to-peak voltage value Vpp at a range ΔVppX', which is shown in FIG. 7B (S110).

Here, the predetermined value γe is a value that is set in advance assuming the state in which the resistance value of the charging roller 2 is increased, such as after the power is turned on or after resuming from sleep.

The control circuit 13, which is an example of a setting unit, sets the peak-to-peak voltage value for obtaining a predetermined amount of discharge current between the photosensitive drum 1 and the charging roller 2. The control circuit 13 sets a peak-to-peak voltage value VppT with which a difference between the approximate straight line in the discharge area Rb, which is expressed by the above-mentioned expression (2), and the approximate straight line in the non-discharge area Ra, which is expressed by the expression (3), becomes a desired amount of discharge current ΔIs, with the following expression (4) (S109/S111).

$$VppT=(\Delta Is-A+B)/(\beta-\gamma) \tag{4}$$

The control circuit 13 determines whether or not the determined peak-to-peak voltage value VppT (S109/S111) is within the set control range (ΔVppX/ΔVppX') of the peak-to-peak voltage (S112/S117).

When the peak-to-peak voltage value VppT is within the control range of the peak-to-peak voltage (Yes in S112, S117), the control circuit 13 outputs the peak-to-peak voltage value VppT (S113/S118), and starts the image formation.

When the peak-to-peak voltage value VppT is outside the control range of the peak-to-peak voltage (No in S112, S117), the control circuit 13 determines whether or not the peak-to-peak voltage value VppT is equal to or more than an upper limit (VppX1/VppX1') of the control range (S114/S119).

When the peak-to-peak voltage value VppT is equal to or more than the upper limit (VppX1/VppX1') of the control range (Yes in S114, Yes in S119), the control circuit 13 outputs the upper limit (VppX1/VppX1') of the control range (S115/S120), and starts the image formation.

When the peak-to-peak voltage value VppT is less than the upper limit (VppX1/VppX1') of the control range (No in S114, No in S119), the control circuit 13 outputs a lower limit (VppX2/VppX2') of the control range (S116/S121), and starts the image formation.

Note that, in the first embodiment, the contact charging type using the charging roller has been described, but the present invention may be applied also to a charging type by means of corona discharge.

The present invention will hereinafter be compared to the related-art methods, which are used as comparative examples.

Comparative Example 1

Comparative Example 1 is a related-art method that adopts an "AC constant current control method" in which a value of an AC current that flows when a test AC voltage is applied to the charging roller 2 is measured, and in which the AC voltage used for the charging voltage is subjected to constant current control with the AC current value determined based on the measured current value. With the "AC constant current control method", the peak-to-peak voltage value Vpp of the AC voltage Vac may be increased in the low-temperature, low-humidity (L/L) environment, in which a resistance of a material of the charging roller 2 is increased, and to the contrary, the peak-to-peak voltage value Vpp of the AC voltage Vac may be reduced in the high-temperature, high-humidity (H/H) environment. In other words, the discharge current amount may be stabilized while adapting to an increase or decrease in discharge current amount due to variations in an amount of water in the air and in air temperature to some extent.

However, in the AC constant current control method, the total current flowing from the charging roller 2 to the photosensitive drum 1 is controlled to be kept constant. Here, the total current amount is the sum of the nip current θVpp flowing through the contact portion between the charging roller 2 and the photosensitive drum 1, and the amount ΔIs of discharge current, which is allowed to flow by the electric discharge at a non-contact portion.

Therefore, in the "AC constant current control method", the AC voltage is controlled with the total current including not only the discharge current amount ΔIs, which is an electric current actually required to electrically charge the photosensitive drum 1, but also the nip current θVpp. Therefore, in reality, the discharge current amount ΔIs cannot be controlled accurately. In the "AC constant current control method", even when the control is performed with the same current value, the increase or decrease in discharge current amount ΔIs cannot be suppressed sufficiently. When the nip current θVpp is increased with a variation in resistance value of the material of the charging roller 2, the discharge current amount ΔIs is reduced accordingly by natural consequences, and to the contrary, when the nip current θVpp is reduced, the discharge current amount ΔIs is increased accordingly.

Comparative Example 2

Comparative Example 2 is a related-art method in which, as described in Patent Literature 1, the discharge current amount ΔIs is separated from the total current flowing through the photosensitive drum 1 when the test AC voltage is applied to the charging roller 2, and the peak-to-peak voltage value Vpp of the AC voltage Vac is set as a constant voltage so that the discharge current amount ΔIs becomes a desired value.

In Comparative Example 2, as illustrated in FIG. 4, the AC current value measuring circuit 14 configured to measure the value of the AC current flowing to the charging roller 2 through the photosensitive drum 1 is included. Then, as shown in FIG. 5, at the times when no image is formed, an AC voltage having a peak-to-peak voltage value Vpp that is less than twice the electric discharge start voltage Vth is applied to the charging roller 2 at one or more points to measure an AC current value. Similarly, the AC voltage having the peak-to-peak voltage value Vpp that is equal to or more than twice the electric discharge start voltage Vth is applied to the charging roller 2 at two or more points to measure the AC current value. Then, based on the measured AC current values, the peak-to-peak voltage value Vpp of the AC voltage Vac to be applied to the charging roller 2 during the image formation is determined.

In Comparative Example 2, as shown in FIG. 5, the current values obtained when the peak-to-peak voltage that is less than twice Vth is applied and 0 are connected to acquire a peak-to-peak voltage-AC current function fI1 (Vpp). Similarly, a peak-to-peak voltage-AC current function fI2 (Vpp) is obtained from the current values at the two or more points, which are obtained when the peak-to-peak voltage that is equal to or more than twice Vth is applied. Then, the peak-to-peak voltage-AC current function fI1 (Vpp) and the peak-to-peak voltage-AC current function fI2 (Vpp) are compared to determine the peak-to-peak voltage value Vpp of the AC voltage Vac for obtaining the discharge current value ΔIs, which is a constant that is determined in advance.

$$fI2(Vpp)-fI1(Vpp)=\Delta Is$$

Then, with the thus-determined peak-to-peak voltage value Vpp, the peak-to-peak voltage value Vpp of the AC voltage Vac to be applied to the charging roller 2 during the image formation is controlled as the constant voltage.

With Comparative Example 2, when the resistance value of the charging roller 2 is constant, a constant discharge current is always obtained, and hence both of the suppression of the scratch on the photosensitive drum 1 and the soiling of the charging roller, and the charging uniformity may be achieved. However, when the resistance value of the charging roller 2 is changed, discharge current control may deviate from appropriate charging conditions in some cases due to a control failure or an error.

In Comparative Example 2, due to the variation in resistance value caused by variation in manufacture or soiling of the charging roller 2, a variation in capacitance of the photosensitive drum 1 accompanying accumulation of the image formation, and a variation in output of the power source, it is difficult to sufficiently suppress the increase or decrease in discharge current, and the life of the photosensitive drum 1 may be shortened.

Comparative Example 3

Comparative Example 3 is a related-art method in which, depending on the control result of discharge current control, a range of an outputtable voltage value is set in advance to a value of an AC voltage to be applied, and the range is adjusted depending on environmental conditions including temperature and humidity. In Comparative Example 3, upper and lower limits of the AC voltage value are set in advance to prevent output of a voltage that is outside the range, to thereby prevent the image defects during the image formation. In the discharge current control, when the peak-to-peak voltage value Vpp that falls outside the appropriate charging conditions is calculated due to the control failure and the error, the upper and lower limits of the voltage value are set in advance so that the voltage that is outside the range is not output. As specific effects, the lower limit may be set in advance to suppress the image defects, such as the sand pattern and the fogging, caused by the charge defect, and the upper limit may be set in advance to suppress the image deletion and the shortened life due to the scratch on the drum.

However, in a normal-temperature, low-humidity environment and the low-temperature, low humidity environment, in which the resistance of the material of the charging roller is increased, a conducting state of the charging roller 2 is changed significantly between the state in which the image forming apparatus is left to stand and is not energized and after the image formation is repeated. When the image formation is repeated, the discharge current amount is gradually increased. As a result, in a case where a set range of the peak-to-peak voltage value Vpp is determined based on the discharge characteristic under the state in which the resistance of the material of the charging roller is high, when the image formation is repeated and the resistance of the material of the charging roller is reduced, the peak-to-peak voltage value Vpp cannot be appropriately set. Also when the peak-to-peak voltage value Vpp is set at the lower limit of the set range of the peak-to-peak voltage, a discharge current that exceeds the discharge current amount required for the image formation may be disadvantageously allowed to flow in some cases.

For example, it is assumed that, as shown in FIG. 6, in order to avoid the image defects, such as the sand pattern in which the white spots appear on the black background, a range in which the peak-to-peak voltage value Vpp can be set is limited as in the Vpp control range E1 based on the discharge characteristic in the state in which the resistance value of the charging roller 2 is increased and including the tolerance. It is then assumed that the image formation on about 500 sheets is accumulated to change the discharge characteristic, and that an optimal peak-to-peak voltage control range is changed to the Vpp control range E2. At this time, even when an attempt is made to output the peak-to-peak voltage value Vpp in accordance with the appropriate amount of discharge current, the peak-to-peak voltage value Vpp cannot be set in a range that is less than the control range E1. Therefore, more than required electric discharge occurs between the charging roller 2 and the photosensitive drum 1, with the result that the degradation of the photosensitive drum 1 and the soiling of the charging roller 2 may be facilitated.

Here, when a wide control range E1 of the peak-to-peak voltage value Vpp is set from the start, such problem does not occur. However, when control failure or accumulated tolerance and control accuracy in various conditions are taken into consideration, it is not preferred to easily widen the control range E1 because of the possibility of leading to the occurrence of the image defects.

In contrast, in the first embodiment, the range in which the peak-to-peak voltage value Vpp can be set is shifted depending on the resistance value of the charging roller 2 to allow widening of the control range only on the side with a margin. Therefore, a constant amount of discharge may always be generated without causing overdischarge while suppressing the risk of the image defects during the image formation. The voltage and electric current to be applied to the charging roller 2 may be appropriately controlled so that uniform electric charging may be performed without causing the scratch on the photosensitive drum, the soiling of the charging roller, and the like.

Effects of First Embodiment

In the first embodiment, at least one of the upper limit or the lower limit of the peak-to-peak voltage value is determined, with respect to the control range in which the resistance value of the charging roller 2, which has been set in advance, is increased, based on the current value obtained when the predetermined voltage is applied between the photosensitive drum 1 and the charging roller 2. Therefore, the range of the peak-to-peak voltage of the AC voltage of the charging voltage may be appropriately set.

In the first embodiment, during the discharge current control for determining the peak-to-peak voltage for controlling the AC voltage as the constant voltage during the image formation, the control range of the peak-to-peak voltage is determined depending on the resistance value of the charging roller 2. Therefore, even when a chargeable characteristic of the photosensitive drum is changed depending on the state of the image forming apparatus, the photosensitive drum may be electrically charged with the appropriate amount of discharge current without the risk of the image defects.

In the first embodiment, during the initial rotation operation and at the periodic timings during printing preparation rotation, the peak-to-peak voltage required to obtain the desired amount of discharge current during the image formation is calculated. Therefore, a deflection in resistance value of the material caused by a variation in manufacture of the charging roller 2 and environmental variations, and a variation in resistance value of the material due to the repeated energization may be absorbed to electrically charge the photosensitive drum 1 with the desired amount of discharge current. Moreover, during the image formation, the determined AC voltage of the peak-to-peak voltage is applied through the constant voltage control, with the result that the variation in output of the charging power source S1 accompanying constant current control may be absorbed to electrically charge the photosensitive drum 1 in a stable manner.

When an analysis is made by operating the image forming apparatus with the control in the first embodiment, the degradation of, and the scratch and a filming amount on the photosensitive drum 1 are reduced than with the control in Comparative Example 3 under any environment. As compared to the discharge current control in Comparative Example 3, extended life of the photosensitive drum 1 is achieved. In Comparative Example 3, in order to suppress the increase or decrease in discharge current amount, it is effective to suppress variations in dimensions during manufacturing of the charging member and in resistance value of the charging member, and the environmental variations, and to suppress a deflection of the high pressure of the power source. However, those measures lead to an increase in cost. In contrast, in the first embodiment, the variation in resistance of the charging roller 2 during manufacturing may be absorbed, and hence allowable ranges are also widened for the material and the accuracy, with the result that a reduction in cost during manufacturing is facilitated, and that the product may be provided to the user at low cost.

Second Embodiment

Figure 10A:
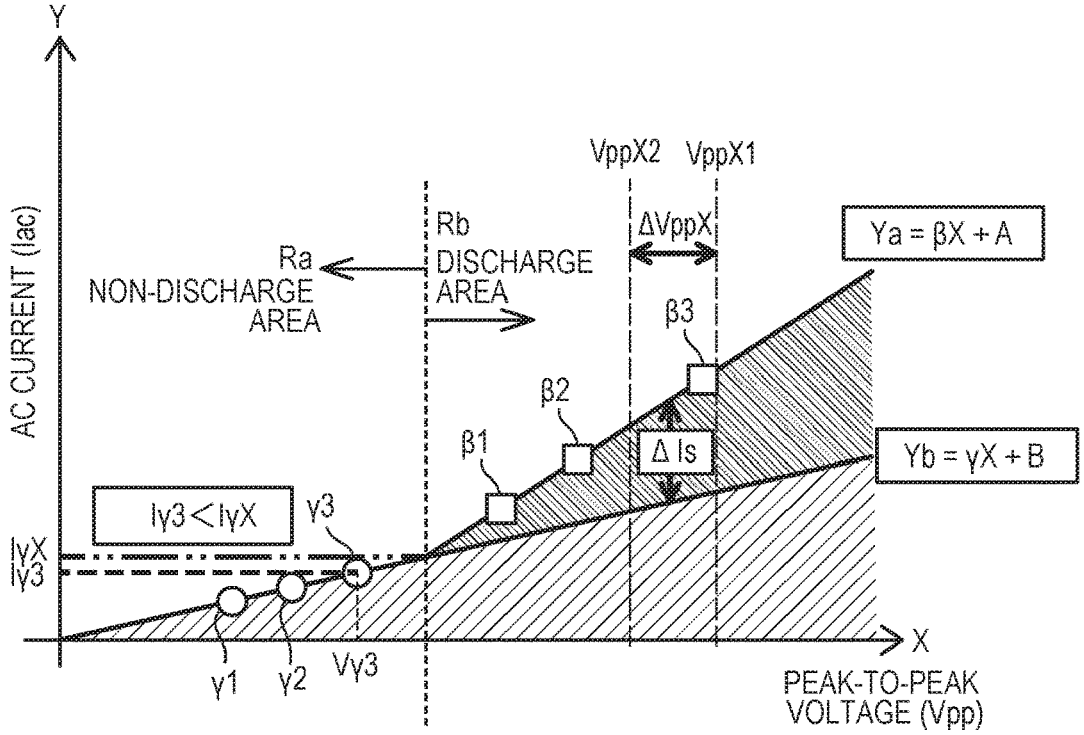
FIG. 10A is an explanatory graph of a concept of discharge current control in a second embodiment of the present invention.
Figure 10B:
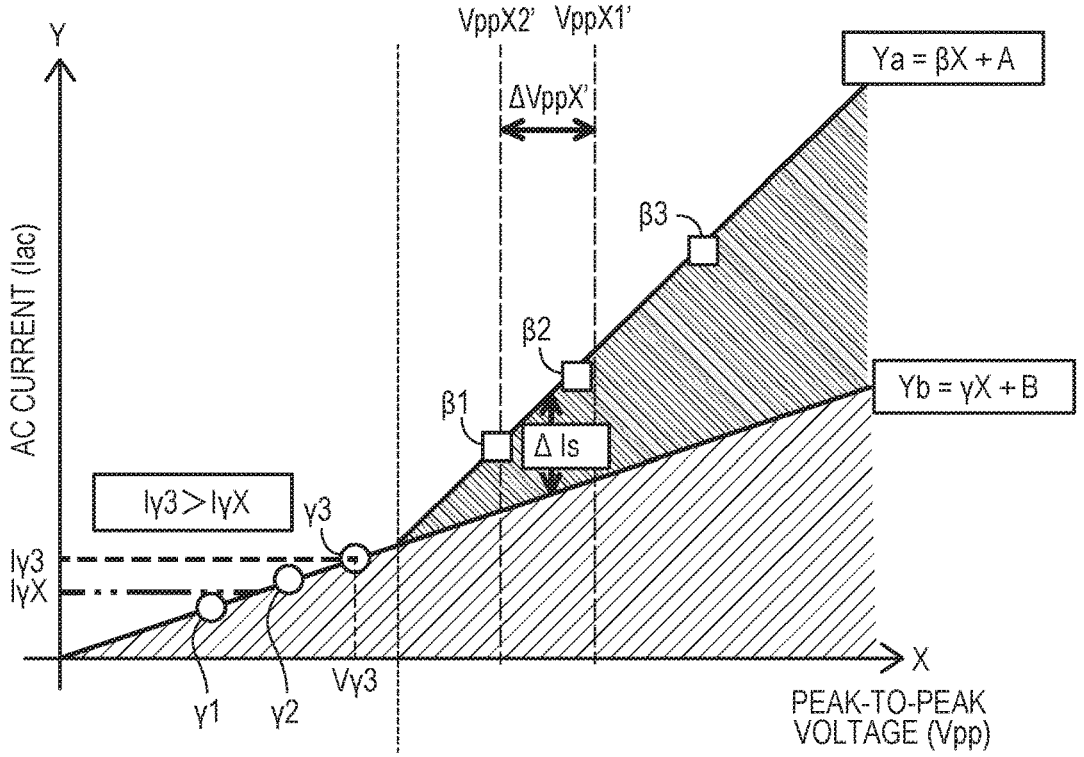
FIG. 10B is an explanatory graph of the concept of the discharge current control in the second embodiment.
Figure 11:
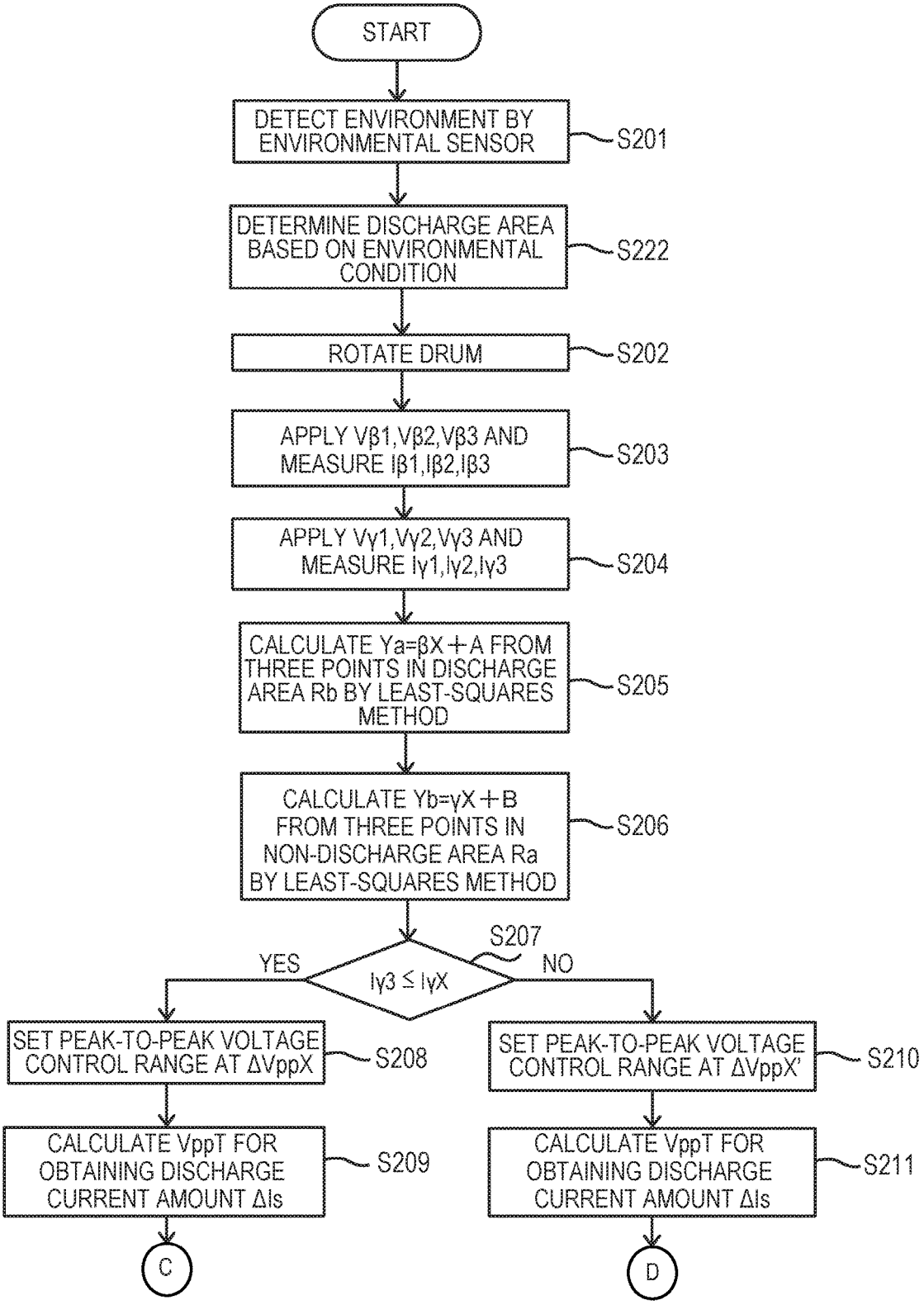
FIG. 11 is a first half portion of a flow chart of control in the second embodiment.
Figure 12A:
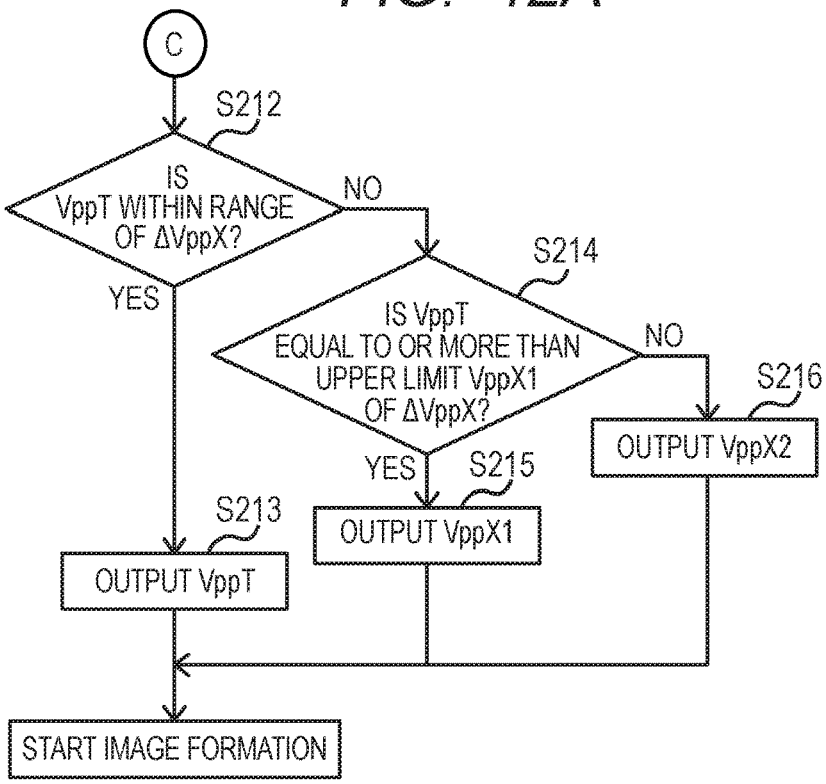
FIG. 12A is a second half of the flow chart of the control in the second embodiment.
Figure 12B:
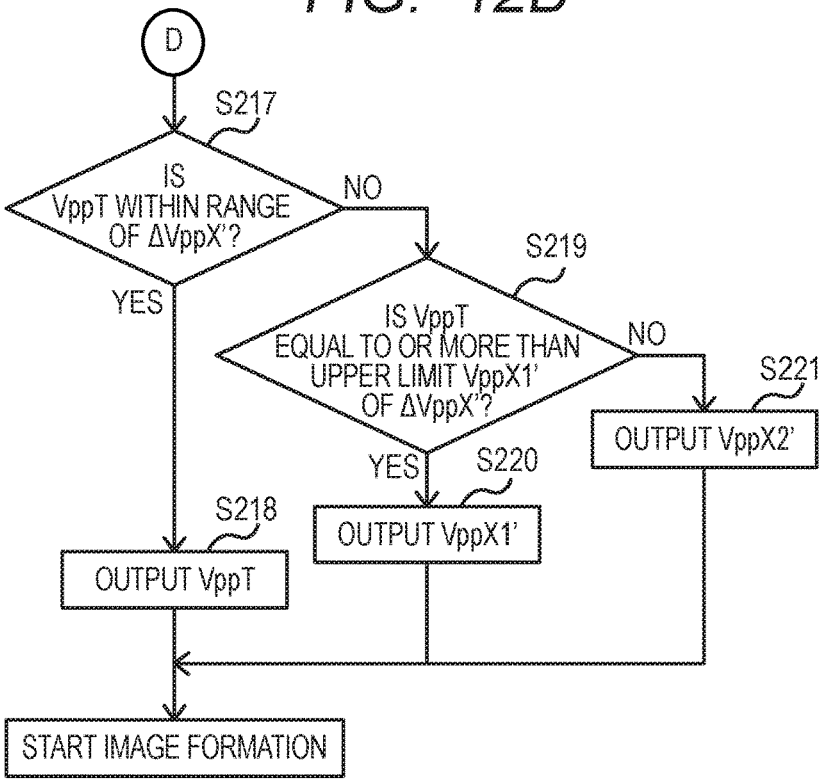
FIG. 12B is a second half of the flow chart of the control in the second embodiment.

FIG. 10A and FIG. 10B are explanatory graphs of a concept of discharge current control in a second embodiment of the present invention. FIG. 11 is a first half portion of a flow chart of control in the second embodiment. Each of FIG. 12A and FIG. 12B is a second half of the flow chart of the control in the second embodiment. FIG. 10A corresponds to a state in which the resistance of the charging roller is high, and FIG. 10B corresponds to the state in which the resistance of the charging roller is lowered after the image formation on about 500 sheets.

The second embodiment is different, in the image forming apparatus 100 described with reference to FIG. 1 to FIG. 6, only in a part of the control for setting the peak-to-peak voltage value Vpp to be applied to the charging roller 2. Therefore, the components and control common to the first embodiment in FIG. 10A to FIG. 12B are denoted by reference symbols common to FIG. 7A to FIG. 9B, and a duplicate description thereof is omitted.

In the first embodiment, in setting the control range of the peak-to-peak voltage, the control range of the peak-to-peak voltage value Vpp is switched in two steps depending on whether or not the slope γ of the approximate straight line in the non-discharge area Ra, which is expressed by the expression (3) described above, exceeds the predetermined value γe. In contrast, in the second embodiment, in setting the control range of the peak-to-peak voltage, the control range of the peak-to-peak voltage value Vpp is switched in two steps depending on whether or not a current value Iγ3, which is obtained when Vγ3 is applied as the peak-to-peak voltage value Vpp in the non-discharge area, exceeds a threshold IγX. In any case, when the resistance value of the charging roller 2 is higher than a threshold, VppX1-VppX2, which is a high range of the peak-to-peak voltage value Vpp, is set, and when the resistance value of the charging roller 2 is lower than the threshold, VppX1'-VppX2', which is a low range of the peak-to-peak voltage value Vpp, is set. Here, the threshold IγX is a value that is set in advance assuming the state in which the resistance value of the charging roller 2 is increased, such as after the power is turned on or after resuming from sleep.

As shown in FIG. 10A, in the second embodiment, based on a detection result of the AC current value measuring circuit 14, which is obtained when a voltage at which a discharge phenomenon does not occur between the photosensitive drum 1 and the charging roller 2 is applied, at least one of the upper limit or the lower limit of the control range is set. The control circuit 13 selects one of values of AC currents Iγ1, Iγ2, and Iγ3, which flow to the charging roller 2 through the photosensitive drum 1 when the peak-to-peak voltage value Vpp in the non-discharge area Ra is sequentially applied at the three points (points γ1, γ2, and γ3 in FIG. 10A). When the selected AC current value exceeds the threshold that is set in advance, the resistance value of the charging roller 2 is reduced, and hence the low control range (VppX') of the peak-to-peak voltage value Vpp is set. To the contrary, when the selected AC current value is equal to or less than the threshold that is set in advance, the resistance value of the charging roller 2 is increased, and hence the high control range (VppX) of the peak-to-peak voltage value Vpp is set. Here, a case where the current value Iγ3, which is obtained when Vγ3 is applied, is compared to the threshold IγX will be described. However, Vγ1 or Vγ2 may be used instead without any problem, and may be selected depending on the environment and features of respective constituent members.

As illustrated in FIG. 11 with reference to FIG. 4, the control circuit 13 executes, during the initial rotation operation and the printing preparing rotation operation, which are illustrated in FIG. 3, a program for determining the appropriate peak-to-peak voltage value of the AC voltage to be applied to the charging roller 2 during the print step, and the control range of the peak-to-peak voltage value.

The control circuit 13 performs detection of the temperature and the humidity by the environmental sensor 15 (S201). Then, the control circuit 13 determines the peak-to-peak voltage value at which the electric discharge is generated between the charging roller 2 and the photosensitive drum 1 based on detection results of the environmental sensor 15 (S222), and starts the rotation of the photosensitive drum 1 (S202).

The control circuit 13 controls the AC power source 12 to apply only the AC voltage Vac in the discharge area Rb to the charging roller 2, and as shown in FIG. 10A, switches the peak-to-peak voltage value Vpp in three steps: Vβ1, Vβ2, and Vβ3. In synchronization with the switching of the peak-to-peak voltage value Vpp in the three steps, the control circuit 13 uses the AC current value measuring circuit 14 to measure Iβ1, Iβ2, and Iβ3 as the AC currents Iac in the discharge area Rb, which flow to the charging roller 2 through the photosensitive drum 1 (S203).

Similarly, the control circuit 13 controls the AC power source 12 to apply only the AC voltage Vac in the non-discharge area Ra to the charging roller 2, and as shown in FIG. 10A, switches the peak-to-peak voltage value Vpp in three steps: Vγ1, Vγ2, and Vγ3. In synchronization with the switching of the peak-to-peak voltage value Vpp in the three steps, the control circuit 13 uses the AC current value measuring circuit 14 to measure Iγ1, Iγ2, and Iγ3 as the AC currents Iac in the non-discharge area Ra, which flow to the charging roller 2 through the photosensitive drum 1 (S204).

The control circuit 13 linearly approximates relationships between the peak-to-peak voltage value Vpp and the AC current Iac in the discharge area Rb and the non-discharge area Ra from the measured AC current values at six points to calculate the expression (2) and expression (3) described above (S205, S206). As shown in FIG. 10A, those approximate straight lines are: the straight line connecting the origin, the point γ1, the point γ2, and the point γ3 in the non-discharge area Ra (S206), and the straight line passing through the point β1, the point β2, and the point β3 in the discharge area Rb (S205).

As shown in FIG. 10A, an AC current Iγ3 in the non-discharge area, which is expressed by the expression (3) described above, is changed depending on the conducting state, that is to say, a resistance characteristic between the charging roller 2 and the photosensitive drum 1.

The control circuit 13 determines whether or not the AC current Iγ3 is equal to or less than the threshold IγX (S207). Then, when the AC current Iγ3 is equal to or less than the threshold IγX (Yes in S207), the control range of the peak-to-peak voltage value Vpp is set at a range ΔVppX, which is shown in FIG. 10A (S208). On the other hand, when the AC current Iγ3 exceeds the threshold IγX (No in S207), the control range of the peak-to-peak voltage value Vpp is set at a range ΔVppX', which is shown in FIG. 10B (S210).

The control circuit 13 sets the peak-to-peak voltage value VppT with which a difference between the approximate straight line in the discharge area Rb, which is expressed by the above-mentioned expression (2), and the approximate straight line in the non-discharge area Ra, which is expressed by the expression (3), becomes the desired amount of discharge current ΔIs, with the above-mentioned expression (4) (S209/S211).

The control circuit 13 determines whether or not the determined peak-to-peak voltage value VppT (S209/S211) is within the set control range (ΔVppX/ΔVppX') of the peak-to-peak voltage (S212/S217). Then, when the peak-to-peak voltage value VppT is within the control range of the peak-to-peak voltage (Yes in S212, S217), the control circuit 13 outputs the peak-to-peak voltage value VppT (S213/S218), and starts the image formation.

When the peak-to-peak voltage value VppT is outside the control range (ΔVppX/ΔVppX') of the peak-to-peak voltage, the control circuit 13 determines whether or not the peak-to-peak voltage value VppT is equal to or more than an upper limit (ΔVpp1X/ΔVpp1X') of the control range (S214/S219). Then, when the peak-to-peak voltage value VppT is equal to or more than the upper limit of the control range (Yes in S214, Yes in S219), the control circuit 13 outputs the upper limit (ΔVpp1X/ΔVpp1X') of the control range (S215/S220), and starts the image formation. However, when the peak-to-peak voltage value VppT is equal to or less than the upper limit of the control range (No in S214, S219), a lower limit (ΔVpp2X/ΔVpp2X') of the control range is output (S216/S221), and the image formation is started.

Third Embodiment

Figure 13A:
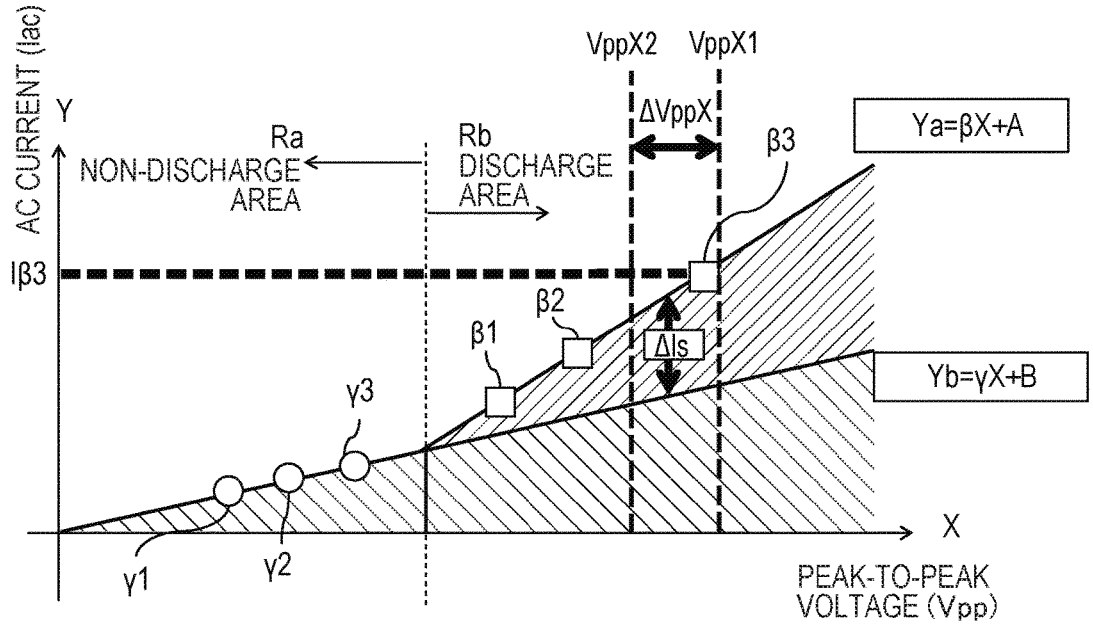
FIG. 13A is an explanatory graph of a concept of discharge current control in a third embodiment of the present invention.
Figure 13B:
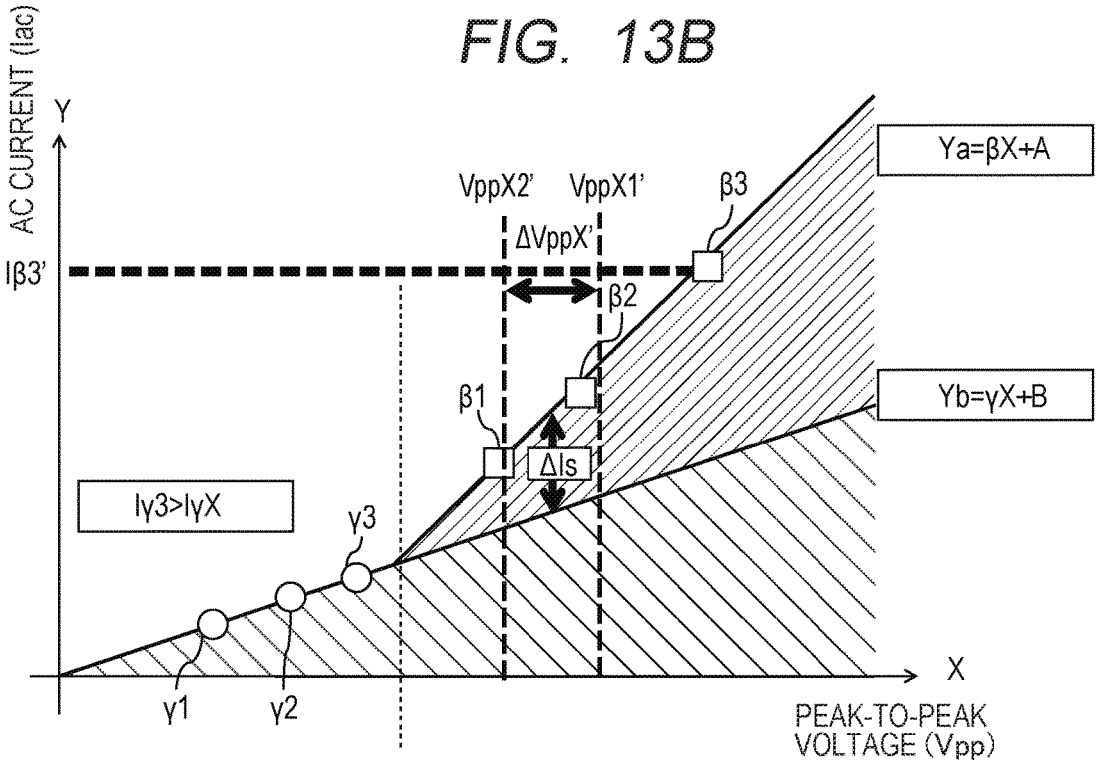
FIG. 13B is an explanatory graph of the concept of the discharge current control in the third embodiment.
Figure 14:
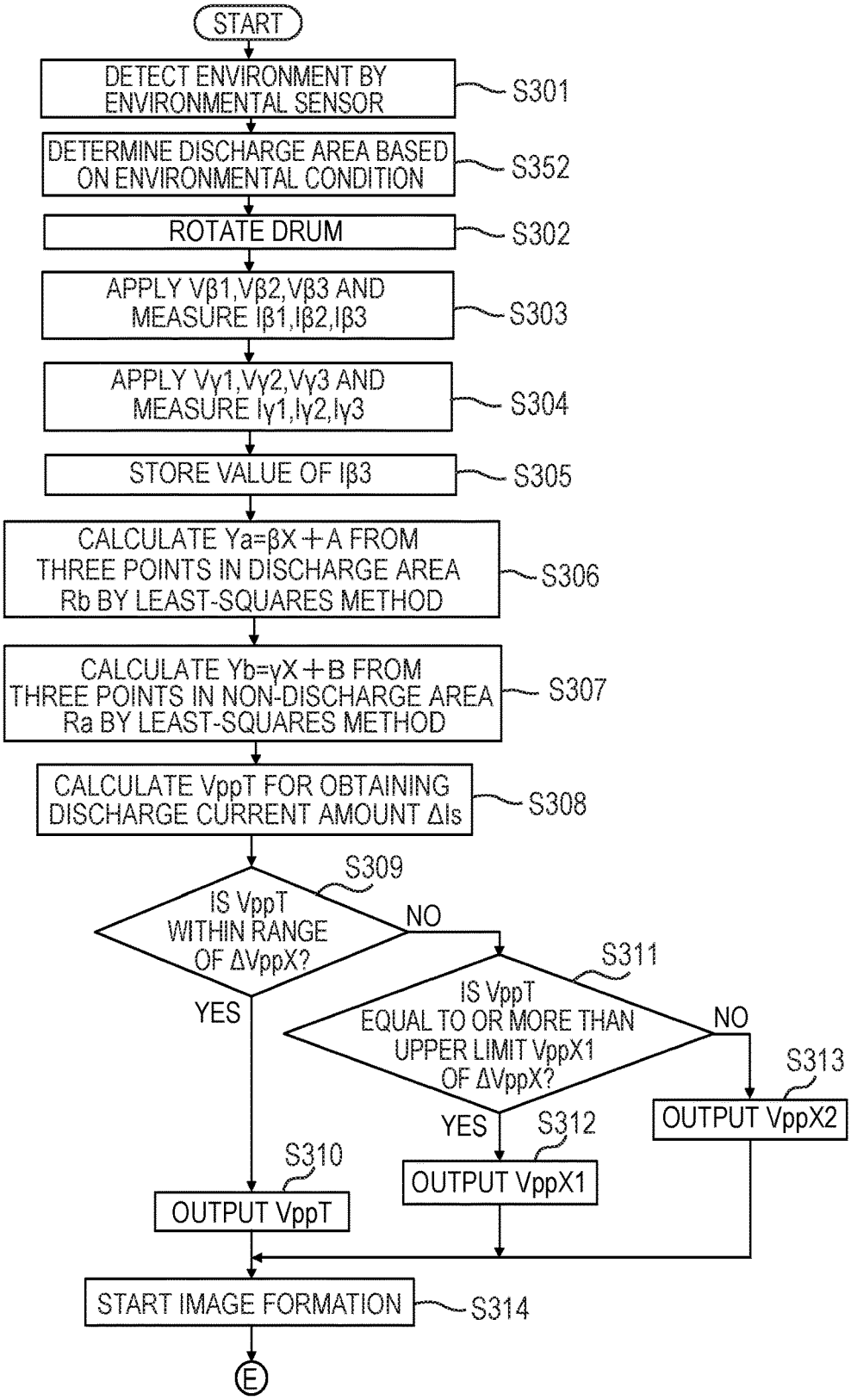
FIG. 14 is a first half portion of a flow chart of control in the third embodiment.
Figure 15:
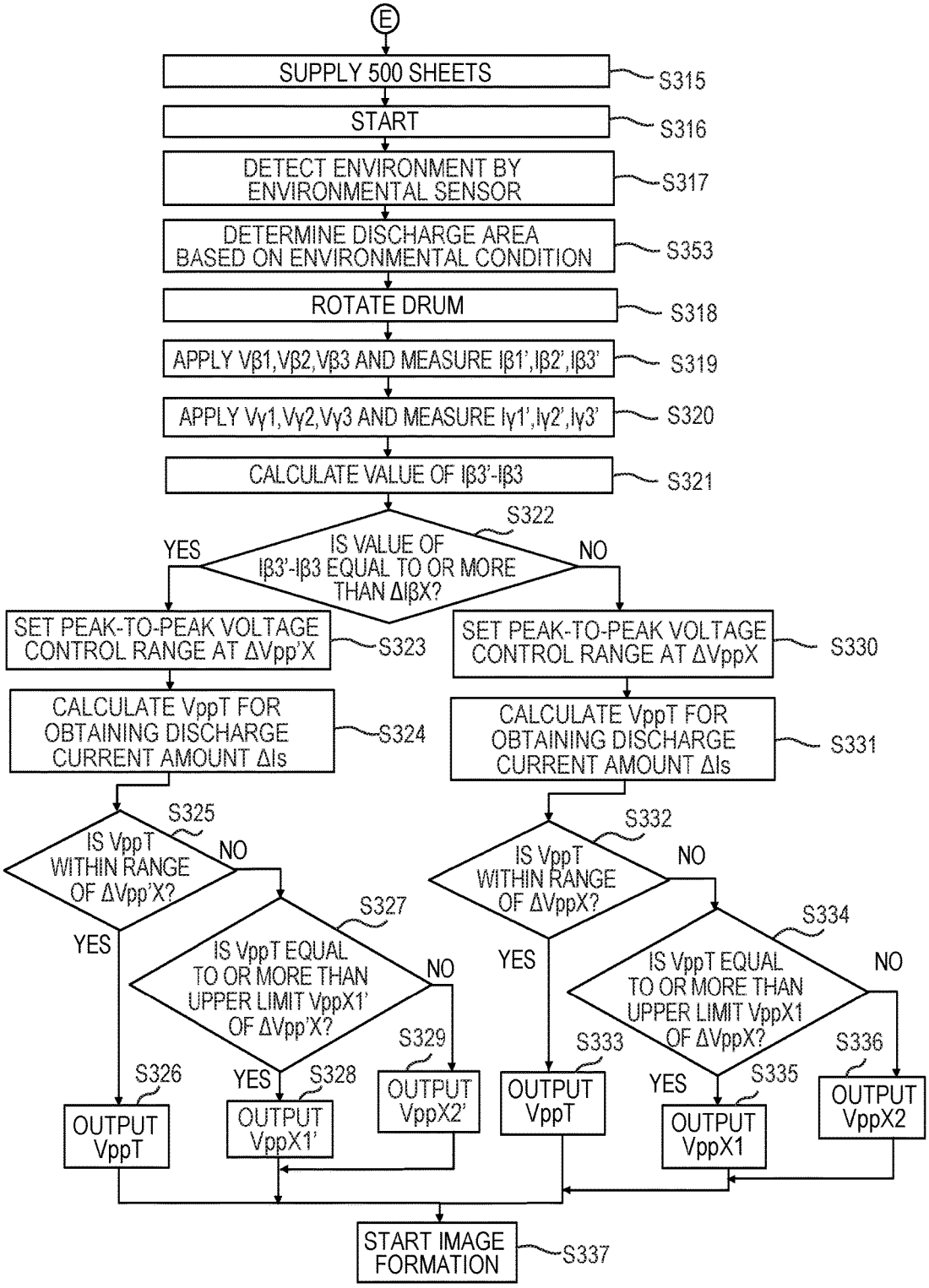
FIG. 15 is a second half portion of the flow chart of the control in the third embodiment.

FIG. 13A and FIG. 13B are explanatory graphs of a concept of discharge current control in a third embodiment of the present invention. FIG. 14 is a first half portion of a flow chart of control in the third embodiment. FIG. 15 is a second half portion of the flow chart of the control in the third embodiment. FIG. 13A corresponds to a state in which the resistance of the charging roller is high, and FIG. 13B corresponds to the state in which the resistance of the charging roller is lowered after the image formation on about 500 sheets.

The third embodiment is different, in the image forming apparatus 100 described with reference to FIG. 1 to FIG. 6, only in a part of the control for setting the peak-to-peak voltage value Vpp. Therefore, the components and control common to the first embodiment in FIG. 13A to FIG. 15 are denoted by reference symbols common to FIG. 7A to FIG. 9B, and a duplicate description thereof is omitted.

In the second embodiment, in setting the control range of the peak-to-peak voltage, the control range of the peak-to-peak voltage value Vpp is switched in two steps depending on whether or not the current value Iγ3, which is obtained when Vγ3 is applied as the peak-to-peak voltage value Vpp in the non-discharge area, exceeds the threshold IγX. In contrast, in the third embodiment, in setting the control range of the peak-to-peak voltage, a current value Iβ3, which is obtained when Vβ3 is applied as the peak-to-peak voltage value Vpp in the discharge area, is detected. Then, depending on whether or not an amount of change in current value Iβ3 from when a main body of the image forming apparatus 100 is activated to after predetermined-number-of-sheet supply exceeds a threshold ΔIβX, the control range of the peak-to-peak voltage value Vpp is switched in two steps. In any case, when an amount of change in resistance value of the charging roller 2 is higher than a threshold, a low range (VppX1'-VppX2') of the peak-to-peak voltage value Vpp is set, and when the amount of change in resistance value of the charging roller 2 is lower than the threshold, a high range (VppX1-VppX2) of the peak-to-peak voltage value Vpp is set.

In the discharge area, a variation in current value with respect to the change in resistance value of the charging roller 2 becomes larger than in the non-discharge area. Therefore, the range of the peak-to-peak voltage value Vpp may be set more easily than in the second embodiment.

As shown in FIG. 13A with reference to FIG. 4, in the third embodiment, based on a detection result of the AC current value measuring circuit 14 obtained when a voltage generated by the discharge phenomenon between the photosensitive drum 1 and the charging roller 2 is applied, the control circuit 13 sets at least one of the upper limit or the lower limit of the control range.

The control circuit 13 measures values of AC currents Iβ1, Iβ2, and Iβ3, which flow to the charging roller 2 through the photosensitive drum 1 when the peak-to-peak voltage value Vpp in the discharge area Rb is subsequently applied at the three points (β1, β2, and β3 in FIG. 13A) during the first activation of the image forming apparatus 100. Then, the above-mentioned program for controlling the peak-to-peak voltage value is executed using measurement results to set the peak-to-peak voltage value Vpp within the range VppX1-VppX2, which is an initially set control range of the peak-to-peak voltage value Vpp, and the image formation is started. Then, Iβ3, which is an AC current value selected from among the measured AC current values Iβ1, Iβ2, and Iβ3, is stored in the storage portion 16.

Thereafter, the control circuit 13 performs control to set the peak-to-peak voltage value Vpp again during the printing preparation rotation after the predetermined-number-of-sheet supply. At this time, as shown in FIG. 13B, the control circuit 13 measures values of AC currents Iβ1', Iβ2', and Iβ3', which flow to the charging roller 2 through the photosensitive drum 1 when the peak-to-peak voltage value Vpp is sequentially applied at the three points (β1, β2, and β3 in FIG. 13B) in the discharge area Rb. Then, a difference between Iβ3', which is an AC current value selected from among the AC current values Iβ1', Iβ2', and Iβ3', and Iβ3, which is stored in the storage portion 16, is calculated. Then, when a value of the calculated difference exceeds the threshold ΔIβX, the resistance value of the charging roller 2 is reduced, and hence the low control range VppX1'-VppX2' of the peak-to-peak voltage value Vpp is set. To the contrary, when the value of the calculated difference is equal to or less than the threshold ΔIβX, an amount of change in resistance value of the charging roller 2 is small, and hence the high control range VppX1-VppX2 of the peak-to-peak voltage value Vpp is set.

Here, a case where the current value Iβ3, which is obtained when the peak-to-peak voltage Vβ3 is applied, is compared to the threshold ΔIβX will be described. However, Vβ1 or Vβ2 may be used instead without any problem, and may be selected depending on the environment and the features of the respective constituent members.

As illustrated in FIG. 14 with reference to FIG. 4, the control circuit 13 executes, during the initial rotation operation and the printing preparing rotation operation, which are illustrated in FIG. 3, a program for determining the appropriate peak-to-peak voltage value of the AC voltage to be applied to the charging roller 2 during the print step, and the control range of the peak-to-peak voltage value.

The control circuit 13 performs detection of the temperature and the humidity by the environmental sensor 15 (S301). Then, the control circuit 13 determines the peak-to-peak voltage value at which the electric discharge is generated between the charging roller 2 and the photosensitive drum 1 based on detection results of the environmental sensor 15 (S352), and starts the rotation of the photosensitive drum 1 (S302).

The control circuit 13 controls the AC power source 12 to apply only the AC voltage Vac in the discharge area Rb to the charging roller 2, and as shown in FIG. 13A, switches the peak-to-peak voltage value Vpp in three steps: Vβ1, Vβ2, and Vβ3. In synchronization with the switching of the peak-to-peak voltage value Vpp in the three steps, the control circuit 13 uses the AC current value measuring circuit 14 to measure Iβ1, Iβ2, and Iβ3 as the AC currents Iac in the discharge area Rb, which flow to the charging roller 2 through the photosensitive drum 1 (S303).

Similarly to the discharge area Rb, the control circuit 13 controls the AC power source 12 to apply only the AC voltage Vac in the non-discharge area Ra to the charging roller 2, and as shown in FIG. 13A, switches the peak-to-peak voltage value Vpp in three steps: Vγ1, Vγ2, and Vγ3. In synchronization with the switching of the peak-to-peak voltage value Vpp in the three steps, the control circuit 13 uses the AC current value measuring circuit 14 to measure Iγ1, Iγ2, and Iγ3 as the AC currents Iac in the non-discharge area Ra, which flow to the charging roller 2 through the photosensitive drum 1 (S304).

The control circuit 13 stores a numerical value of Iγ3, which is one point selected from among the measured AC current values, in the storage portion 16 (S305).

Based on the measured AC current values at six points, the control circuit 13 linearly approximates the relationships between the peak-to-peak voltage value Vpp in the discharge area Rb and the non-discharge area Ra, and the AC current Iac to calculate the expressions (2) and (3) described above (S306, S307). As shown in FIG. 13A, those approximate straight lines are: the straight line connecting the origin, the point γ1, the point γ2, and the point γ3 in the non-discharge area Ra (S307), and the straight line passing through the point 131, the point β2, and the point β3 in the discharge area Rb (S306).

As shown in FIG. 13A and FIG. 13B, an AC current Iβ3 in the discharge area is changed depending on the conducting state, that is to say, the resistance characteristic between the charging roller 2 and the photosensitive drum 1.

The control circuit 13 determines the peak-to-peak voltage value VppT with which a difference between the approximate straight line in the discharge area Rb, which is expressed by the above-mentioned expression (2), and the approximate straight line in the non-discharge area Ra, which is expressed by the expression (3), becomes the desired amount of discharge current ΔIs, with the above-mentioned expression (4) (S308).

The control circuit 13 determines whether or not the determined peak-to-peak voltage value VppT (S308) is within the initially set control range of the peak-to-peak voltage (S309). Then, when the peak-to-peak voltage value VppT is within the control range of the peak-to-peak voltage (Yes in S309), the control circuit 13 outputs the peak-to-peak voltage value VppT (S310), and starts the image formation (S314).

When the peak-to-peak voltage value VppT is outside the control range of the peak-to-peak voltage, the control circuit 13 determines whether or not the peak-to-peak voltage value VppT is equal to or more than an upper limit of the control range (S311). Then, when the peak-to-peak voltage value VppT is equal to or more than the upper limit of the control range (Yes in S311), the control circuit 13 outputs the upper limit VppX1 of the control range (S312), and starts the image formation (S314). However, when the peak-to-peak voltage value VppT is less than the upper limit of the control range (No in S311), the control circuit 13 outputs the lower limit VppX2 of the control range (S313), and starts the image formation (S314).

As illustrated in FIG. 15 with reference to FIG. 4, after starting the image formation, the control circuit 13 counts the number of printed sheets, and when detecting 500-sheet supply (S315), starts control on the charging voltage (S316). The control circuit 13 performs the detection of the temperature and the humidity by the environmental sensor 15 (S317). Then, the control circuit 13 determines the peak-to-peak voltage value at which the electric discharge is generated between the charging roller 2 and the photosensitive drum 1 based on the detection results of the environmental sensor 15 (S353), and starts the rotation of the photosensitive drum 1 (S318).

The control circuit 13 controls the AC power source 12 to apply only the AC voltage Vac in the discharge area Rb to the charging roller 2, and as shown in FIG. 13B, switches the peak-to-peak voltage value Vpp in three steps: Vβ1, Vβ2, and Vβ3. In synchronization with the switching of the peak-to-peak voltage value Vpp in the three steps, the control circuit 13 uses the AC current value measuring circuit 14 to measure Iβ1', Iβ2', and Iβ3' as the AC currents Iac in the discharge area Rb, which flow to the charging roller 2 through the photosensitive drum 1 (S319).

Similarly to the case of the discharge area Rb, the control circuit 13 controls the AC power source 12 to apply only the AC voltage Vac in the non-discharge area Ra to the charging roller 2, and as shown in FIG. 13B, switches the peak-to-peak voltage value Vpp in three steps: Vγ1, Vγ2, and Vγ3. In synchronization with the switching of the peak-to-peak voltage value Vpp in the three steps, the control circuit 13 uses the AC current value measuring circuit 14 to measure Iγ1', Iγ2', and Iγ3' as the AC currents Iac in the non-discharge area Ra, which flow to the charging roller 2 through the photosensitive drum 1 (S320).

The control circuit 13 calculates a value of Iβ3'-Iβ3, which is a difference between the measured current value Iβ3' and Iβ3, which is stored in the storage portion 16 (S321).

The control circuit 13 determines whether or not a value of the calculated difference Iβ3'-Iβ3 is equal to or more than the threshold ΔIβX (S322). Then, when the difference value is equal to or more than the threshold ΔIβX (Yes in S322), the control range of the peak-to-peak voltage value Vpp is set at a range ΔVppX', which is shown in FIG. 13B (S323). On the other hand, when the value of the calculated difference Iβ3'-Iβ3 is less than the threshold ΔIβX (No in S322), the control range of the peak-to-peak voltage value Vpp is set at a range ΔVppX, which is an initially set value and shown in FIG. 13A (S330).

The control circuit 13 determines the peak-to-peak voltage value VppT with which a difference between the approximate straight line in the discharge area Rb, which is expressed by the above-mentioned expression (2), and the approximate straight line in the non-discharge area Ra, which is expressed by the expression (3), becomes the desired amount of discharge current ΔIs, with the expression (4) described above (S324/S331).

The control circuit 13 determines whether or not the determined peak-to-peak voltage value VppT (S324/S331) is within the set control range (ΔVppX'/ΔVppX) of the peak-to-peak voltage value Vpp (S325/S332). Then, when the peak-to-peak voltage value VppT is within the control range (ΔVppX'/ΔVppX) of the peak-to-peak voltage (Yes in S325, S332), the control circuit 13 outputs the peak-to-peak voltage value VppT (S326/S333), and starts the image formation (S337).

When the peak-to-peak voltage value VppT is outside the control range (ΔVppX'/ΔVppX) of the peak-to-peak voltage (No in S325, No in S332), the control circuit 13 determines whether or not the peak-to-peak voltage value VppT is equal to or more than the upper limit of the control range (S327/S334). Then, when the peak-to-peak voltage value VppT is equal to or more than the upper limit (ΔVppX1'/ΔVppX1) of the control range (Yes in S327, Yes in S334), the control circuit 13 outputs the upper limit (ΔVppX1'/ΔVppX1) of the control range (S328/S335), and starts the image formation (S337). However, when the peak-to-peak voltage value VppT is equal to or less than the upper limit (ΔVppX1'/ΔVppX1) of the control range (No in S327, No in S334), the control circuit 13 outputs the lower limit (ΔVppX2'/ΔVppX2) of the control range (S329/S336), and starts the image formation (S337).

Note that, in the third embodiment, the value of Iβ3 is set at the time of initial activation, but may be set in advance assuming the state in which the resistance value of the charging roller 2 is increased, such as after the power is turned on or after resuming from sleep.

Other Embodiments

As long as the variable upper limit is set in the control in which the peak-to-peak voltage value Vpp of the AC voltage Vac of the charging voltage is set, the present invention may be embodied as other embodiments in which a part or all of the components in the first to third embodiments are replaced by alternative components thereof.

Therefore, dimensions, materials, and shapes of the constituent parts described in the first to third embodiments, and relative arrangement, dimensions, and angles thereof, and the like are not limited thereto in terms of the scope of the present invention unless otherwise specifically noted.

In the first to third embodiments, during the initial rotation operation of the image forming apparatus 100 and during the printing preparation rotation after printing every 500 sheets, the control in which the peak-to-peak voltage value Vpp is set has been performed, but similar control may be executed at other timings, such as in the inter-sheet spacing step. An interval of the control in which the peak-to-peak voltage value Vpp is set may be set as time, or may be specified as another number of sheets.

In the first embodiment, in performing the control in which the AC voltage for obtaining the predetermined discharge current by applying the AC voltage is set, that is, when the discharge current control is performed, the resistance value of the charging roller 2 has been measured indirectly based on the measurement results. However, a value of a current, which flows through the charging roller 2 when a predetermined voltage is output from the DC power source 11, may be measured to directly determine the resistance value of the charging roller 2. A value of a current, which flows through the charging roller 2 when a predetermined voltage is output from the AC power source, may be measured to directly determine the resistance value of the charging roller 2.

In the first and second embodiments, the value of the current, which flows through the charging roller when the predetermined voltage is output from the AC power source 12 in the area of the non-discharge area Ra, has been measured, and the control range of the peak-to-peak voltage value Vpp has been determined based on the measured value. However, the value of the current, which flows through the charging roller when the predetermined voltage is output in the discharge area Rb, may be measured, and the control range may be determined after the slope and the current value are compared to each other based on the measured value.

Moreover, in the first and second embodiments, the range of the peak-to-peak voltage value has been controlled based on the AC current value in the non-discharge area, but when stated differently, the range of the peak-to-peak voltage value may be said to be controlled based on the change in resistance value of the charging roller 2. Therefore, as a modified example, the resistance value of the charging roller 2 may be estimated from detection results of the temperature and humidity around the charging roller 2 to determine the control range of the peak-to-peak voltage value. In that case, as the temperature becomes higher, or as the humidity becomes higher, the upper limit may be set lower to avoid a situation in which the excessive peak-to-peak voltage is applied in the state in which the resistance value of the charging roller is reduced to impair the life of the photosensitive drum 1.

Further, a relationship between the number of supplied sheets and the increase in temperature of the charging roller 2 may be set in advance to estimate the change in resistance value of the charging roller 2 based on the number of supplied sheets, and to determine the control range of the peak-to-peak voltage value.

In the third embodiment, the value of the current, which flows through the charging roller when the predetermined voltage is output from the AC power source 12 in the area of the discharge area Rb, has been measured, and the amount of change in current value from the initial activation to after the predetermined-number-of-sheet supply has been calculated to determine the control range of the peak-to-peak voltage value Vpp based on the amount of change. However, the value of the current, which flows through the charging roller when the predetermined voltage is output from the AC power source 12 in the non-discharge area Ra, may be measured, and the amount of change in current value after the predetermined-number-of-sheet supply may be calculated to determine the control range based on the calculated value.

In the third embodiment, the upper and lower limits of the peak-to-peak voltage value Vpp has been set based on the amount of change in value of the current flowing through the charging roller, and then it has been determined whether the determined value of the peak-to-peak voltage value Vpp is within the range of the upper and lower limits to perform the image formation. However, as soon as it has been detected that the amount of change in value of the current flowing through the charging roller has exceeded the predetermined value, the peak-to-peak voltage value Vpp may be set at a predetermined value exceeding the upper and lower limits to start the image formation.

This application claims the benefit of Japanese Patent Application No. 2014-243702, filed Dec. 2, 2014, and Japanese Patent Application No. 2015-232974, filed Nov. 30, 2015, which are hereby incorporated by reference herein in their entirety.

REFERENCE SIGNS LIST

1 photosensitive drum (image bearing member)
2 charging roller (charging unit)
3 exposure device
4 developing device
5 transfer roller
6 drum cleaning device
7 fixing device
11 DC power source
12 AC power source
13 control circuit (control unit)
14 AC current value measuring circuit (current detection unit)
15 environmental sensor
16 storage portion
S1 charging power source

The invention claimed is:

1. An image forming apparatus, comprising:

an image bearing member;

a charging unit configured to charge the image bearing member by applying an oscillating voltage between the charging unit and the image bearing member;

a setting unit configured to set an oscillating voltage having a peak-to-peak voltage for obtaining a predetermined discharge current between the charging unit and the image bearing member by the charging unit based on a first electric current value flowing between the charging unit and the image bearing member when an oscillating voltage with which a discharge phenomenon occurs between the charging unit and the image bearing member is applied to between the charging unit and the image bearing member, and based on a second electric current value flowing between the charging unit and the image bearing member when an oscillating voltage with which the discharge phenomenon does not occur between the charging unit and the image bearing member is applied to between the charging unit and the image bearing member; and a determination unit configured to determine, based on the second electric current value, at least one of an upper limit and a lower limit of the peak-to-peak voltage set by the setting unit.

2. An image forming apparatus according to claim 1, further comprising a humidity detection unit configured to detect a humidity around the charging unit, wherein the determination unit determines, based on a detection result of the humidity detection unit, the upper limit to be lower as an amount of water in air around the charging unit becomes larger.

3. An image forming apparatus according to claim 1, further comprising a temperature detection unit configured to detect a temperature around the charging unit, wherein the determination unit determines, based on a detection result of the temperature detection unit, the upper limit to be lower as the temperature around the charging unit becomes higher.

4. An image forming apparatus according to claim 1, wherein the second electric current value is provided with a plurality of electric current values flowing between the charging unit and the image bearing member when a plurality of oscillating voltages with which the discharge phenomenon does not occur are applied to between the charging unit and the image bearing member.

* * * * *